US010932340B2

(12) United States Patent
Edwards et al.

(10) Patent No.: US 10,932,340 B2
(45) Date of Patent: Feb. 23, 2021

(54) DIGITALLY ADJUSTABLE FOCUSED BEAM LIGHTING SYSTEM

(71) Applicant: NBCUniversal Media, LLC, New York, NY (US)

(72) Inventors: Charles Edwards, Mesa, AZ (US); Richard Pierceall, New York, NY (US)

(73) Assignee: NBCUniversal Media, LLC, New York, NY (US)

( * ) Notice: Subject to any disclaimer, the term of this patent is extended or adjusted under 35 U.S.C. 154(b) by 0 days.

(21) Appl. No.: 16/381,984

(22) Filed: Apr. 11, 2019

(65) Prior Publication Data

US 2019/0320514 A1 Oct. 17, 2019

Related U.S. Application Data

(60) Provisional application No. 62/657,476, filed on Apr. 13, 2018.

(51) Int. Cl.

| | |
|---|---|
| ***H05B 45/20*** | (2020.01) |
| ***F21V 29/51*** | (2015.01) |
| ***F21V 29/67*** | (2015.01) |
| ***F21V 29/70*** | (2015.01) |
| ***F21V 7/06*** | (2006.01) |
| ***F21Y 115/10*** | (2016.01) |

(52) U.S. Cl.

CPC ..... *H05B 45/20* (2020.01); *F21V 7/06* (2013.01); *F21V 29/51* (2015.01); *F21V 29/677* (2015.01); *F21V 29/70* (2015.01); *F21Y 2115/10* (2016.08)

(58) Field of Classification Search

CPC ... H05B 33/0863; H05B 45/20; F21V 29/677; F21V 29/51; F21V 29/70; F21V 7/06; F21Y 2115/10

See application file for complete search history.

(56) References Cited

U.S. PATENT DOCUMENTS

| | | | | |
|---|---|---|---|---|
| 6,072,280 | A | 6/2000 | Allen | |
| 6,160,359 | A | 12/2000 | Fleischmann | |
| 9,723,680 | B2 | 8/2017 | Pope et al. | |
| 9,930,742 | B1 | 3/2018 | Sooch et al. | |
| 9,930,763 | B1 | 3/2018 | Trickler et al. | |
| 10,111,275 | B2 | 10/2018 | Norton et al. | |
| 10,174,890 | B2 | 1/2019 | Di Trapani et al. | |
| 2003/0227774 | A1* | 12/2003 | Martin | F21S 41/151 362/240 |
| 2006/0001384 | A1 | 1/2006 | Tain et al. | |
| 2006/0076908 | A1 | 4/2006 | Morgan et al. | |
| 2009/0201374 | A1 | 8/2009 | Hung et al. | |
| 2009/0243493 | A1 | 10/2009 | Bergquist | |

(Continued)

FOREIGN PATENT DOCUMENTS

| | | | |
|---|---|---|---|
| EP | 3208515 A1 * | 8/2017 | F21V 23/04 |

OTHER PUBLICATIONS

Extended European Search Report dated Jun. 27, 2019 (8 pages).

*Primary Examiner* — Raymond R Chai

(74) *Attorney, Agent, or Firm* — Fletcher Yoder, P.C.

(57) ABSTRACT

A lighting assembly includes a lighting tower. The lighting tower includes a plurality of layers of lighting elements, where each layer of lighting elements is configured to provide a different angle of emitted light onto a parabolic reflector with respect to light emitted from another layer of lighting elements onto the parabolic reflector when activated.

23 Claims, 22 Drawing Sheets

(56) References Cited

U.S. PATENT DOCUMENTS

| | | | | |
|---|---|---|---|---|
| 2012/0206050 | A1 | 8/2012 | Spero | |
| 2013/0170176 | A1* | 7/2013 | Athalye | F21V 3/00 362/84 |
| 2013/0176723 | A1 | 7/2013 | Yang et al. | |
| 2013/0214698 | A1 | 8/2013 | Aliakseyeu et al. | |
| 2015/0233558 | A1* | 8/2015 | Ticktin | F21V 21/047 362/404 |
| 2016/0351118 | A1* | 12/2016 | Knepper | G09G 3/3208 |
| 2017/0030567 | A1* | 2/2017 | Sun | F21V 29/59 |
| 2017/0354022 | A1 | 12/2017 | Dimberg et al. | |
| 2018/0073686 | A1 | 3/2018 | Quilici et al. | |
| 2018/0306412 | A1* | 10/2018 | Halliwell | F21V 5/007 |
| 2019/0053403 | A1* | 2/2019 | Lin | H01L 23/473 |

* cited by examiner

DIGITALLY ADJUSTABLE FOCUSED BEAM LIGHTING SYSTEM

CROSS-REFERENCE TO RELATED APPLICATIONS

This application claims priority from and the benefit of U.S. Provisional Application Ser. No. 62/657,476, entitled "DIGITALLY ADJUSTABLE FOCUSED BEAM LIGHTING SYSTEM", filed Apr. 13, 2018, which is hereby incorporated by reference.

BACKGROUND

The disclosure relates generally to a digitally adjustable focused beam lighting system.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

In the motion picture and television industries, one of the most popular lighting instruments used is a focused beam light known as a "hard light." Some lighting systems use a Fresnel glass optic combined with a tungsten bulb light source. The beam angle of "Fresnel" lights is typically user adjustable from 15 to 50 degrees. The adjustment is performed by turning a mechanical actuator that changes the focal distance between the lens and the Fresnel optic by moving either the light source or the lens. In many instances, this requires the operator to be able to physically adjust mechanical controls to change the beam angle. This can be quite problematic, as many installations are elevated in a lighting system above a stage, making access of the mechanical actuator problematic.

Another limitation of these traditional Fresnel lights is the light source. Traditional systems have included carbon arcs, tungsten light bulbs, and hydrargyrum medium-arc iodide ("HMI") light bulbs. The carbon arcs are very temperamental, require significant maintenance, consume significant power, and generate large amounts of ozone. Tungsten bulbs have a low lifespan (e.g., a 500-hour life). When Fresnel lights near the end of their lifespan, the lights may exhibit a shift in color which could lead to unfavorable lighting. Further, 95% of the energy is wasted on heat, and they can only emit one color-correlated temperature ("CCT") of light—3,200K. HMI bulbs were developed to provide a 5,600K light source which is commonly needed in motion pictures to simulate outdoor light. These lights bulbs have a similar 500-hour lifetime and are also not CCT adjustable. As a result, studios typically stock two completely different types of Fresnel lights, HMI and tungsten, in order to support the two commonly used color temperatures for motion picture and television. Like the original Fresnel lights, both HMI and tungsten lights utilize manual beam angle adjustment while providing increased power. For example, HMI lights come in sizes up to 18,000 Watts. This provides an extreme amount of light that allows film makers to simulate a hard, bright light source like the sun.

Light-emitting diode ("LED") technology has been introduced that uses similar Fresnel optics. However, the LED replacements require more conservative operating temperatures to keep from damaging the LEDs. LED light sources are also much larger than their tungsten and HMI bulb counterparts. The results are LED Fresnel lights that are high cost but very low power (1/10 or less) compared to traditional tungsten and HMI Fresnel lights.

Further, color adjustable LED Fresnel lights have also been introduced. These further reduce the power, because the LED light size needed is larger when it contains a variety of different color LEDs used for color blending. These LED Fresnel lights also use manual beam control adjustment similar to traditional systems.

Another focused beam technology is a HMI parabolic reflector. This light replaces the Fresnel optic lens with a parabolic reflector. Parabolic reflectors offer higher optical efficiency and lower weight than their glass lens, Fresnel counterparts. Parabolic reflector technology is used in lights in many industries. However, such lights with parabolic reflectors face the same limitations described above of a low bulb lifetime, static CCT, and manual adjustment-based change of beam angle.

BRIEF DESCRIPTION

The lighting system disclosed in an embodiment herein provides a high-power lighting element (e.g., an LED light source) with beam control capability of 15 to 50 degrees that may be controlled digitally, allowing the beam angle to be remotely adjusted without local manual adjustment of the lighting element itself. In further embodiments, unique configurations of the LED light sources and color spectrums also offer higher power in a smaller space. Additionally, the lighting system provides a method of controlling CCT more efficiently and with a smaller light source than other LED light sources.

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a lighting assembly includes a lighting tower. The lighting tower includes a plurality of layers of lighting elements, where each layer of lighting elements is configured to provide a different angle of emitted light onto a parabolic reflector with respect to light emitted from another layer of lighting elements onto the parabolic reflector when activated.

In an embodiment, a hardware circuitry-implemented method for adjusting a beam angle of a lighting assembly includes identifying a desired beam angle based upon one or more inputs from a user interface, identifying one or more layers of lighting elements of a lighting tower that, when activated within a parabolic reflector, generate the desired beam angle, and providing a first activation request to the one or more layers of the lighting elements. The first activation request causes activation of the one or more layers of the lighting elements, and the activation of the one or more layers of the lighting elements generates the desired beam angle.

In an embodiment, a hardware circuitry-implemented method for providing an adjustable color-correlated temperature ("CCT") includes receiving an indication of a desired CCT from a user interface, determining one or more adjustments to one or more supplementary light sources, that would result in the desired CCT when light from the one or more supplementary light sources is blended with a base light from a base light source, and performing the one or more adjustments to the one or more supplementary light sources to generate the desired CCT.

In an embodiment, a lighting assembly includes a lighting tower configured to emit light and a cooling system configured to cool the lighting tower. The cooling system includes one or more heat pipes extending into the lighting tower, a condenser configured to cool a coolant passing through the one or more heat pipes, and a pump configured to pump the coolant from the condenser, through the one or more heat pipes, and back to the condenser. The coolant is configured to absorb heat generated by the lighting tower due to light emission as the coolant passes through the one or more heat pipes.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1:
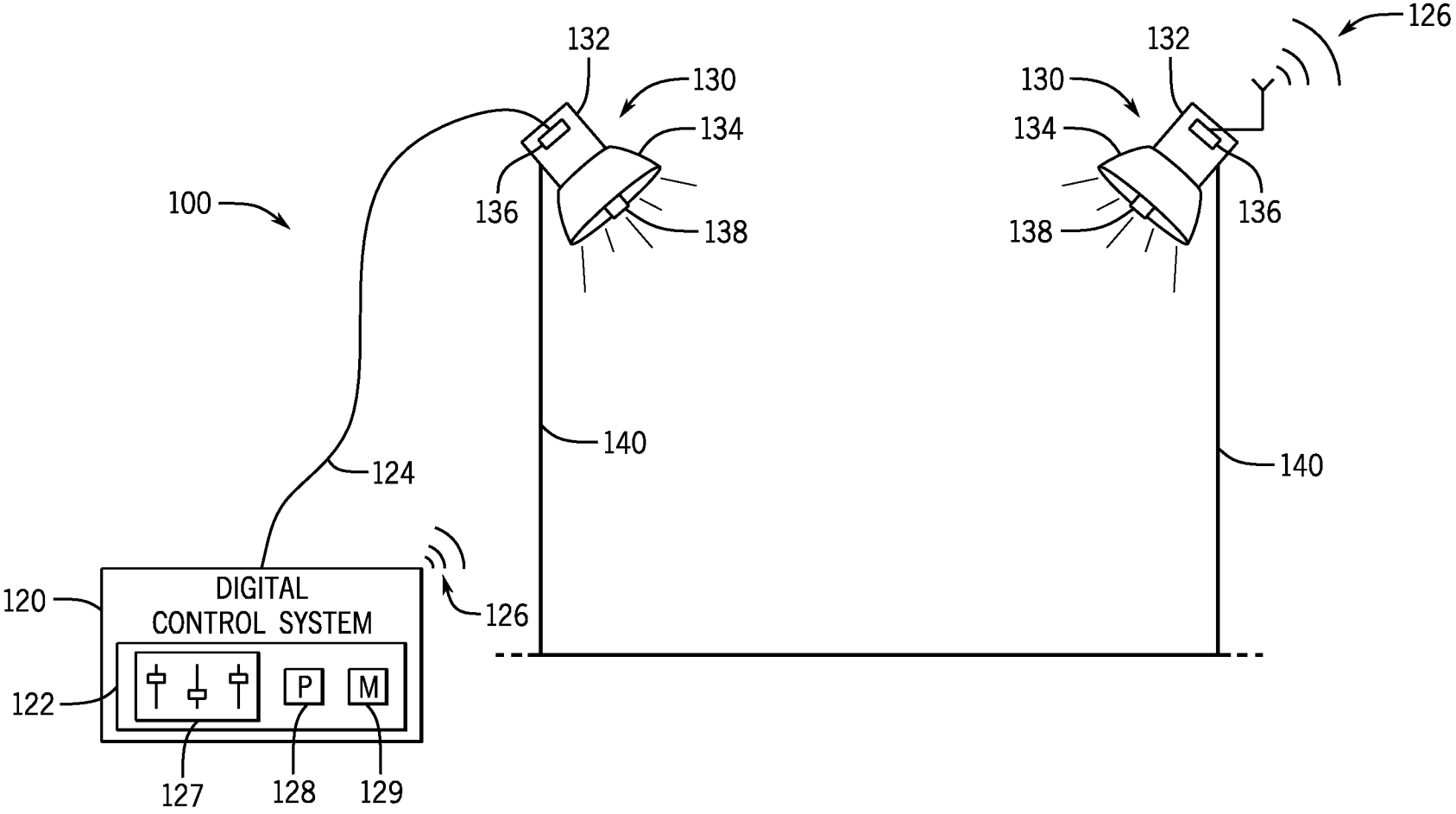
FIG. 1 is an illustration of an exemplary digitally adjustable lighting system, in accordance with one or more current embodiments.

Turning now to the drawings, FIG. 1 illustrates a lighting system 100 that may be suitable to provide lighting for applications such as television and theater sets, film sets, tradeshows, and any one of the range of permanent, semi-permanent, and temporary settings. In the illustrated embodiment, the lighting system 100 includes a digital control system 120 and one or more lighting assemblies 130. As illustrated, the lighting system 100 includes two lighting assemblies 130 supported by lighting stands 140. However, the lighting assemblies 130 may also be suspended from a lighting rig or supported in other manners.

The digital control system 120 includes a controller 122 configured to receive inputs from a user and determine outputs to be provided to the lighting assemblies 130. The controller 122 includes a user interface 127, a processor 128, and a memory 129. Each lighting assembly 130 may include a chassis 132, a parabolic aluminized reflector ("PAR") 134, a lighting assembly controller 136, and a lighting tower 138, among other components. In some embodiments, a lighting assembly 130 may be controlled directly from the controller 122 such that the lighting assembly does not include an independent controller.

In some embodiments, the memory 129 may include one or more tangible, non-transitory, computer-readable media that store instructions executable by the processor 128 and/or data to be processed by the processor 128. For example, the memory 129 may include random access memory (RAM), read only memory (ROM), rewritable non-volatile memory such as flash memory, hard drives, optical discs, and/or the like. Additionally, the processor 128 may include one or more general purpose microprocessors, one or more application specific processors (ASICs), one or more field programmable logic arrays (FPGAs), or any combination thereof.

As described in greater detail below, the lighting system 100 is configured to receive inputs at the user interface 127 of the controller 122 indicative of a desired beam angle, a desired color, and/or a desired CCT for individual or multiple lighting assemblies 130. For example, a user may provide inputs indicative of a desired beam angle, a desired color, and/or a desired CCT to the user interface 127. A processor 128 of the controller 122 may then determine specific lighting adjustments, such as a beam angle adjustment or power values to be supplied to specific lights (e.g., lighting elements) of the lighting towers 138, based on information stored in a memory 129. In some embodiments, the lighting assembly controller 136 may have a processor and memory and may be configured to determine the specific lighting adjustments. The lighting assembly controller 136 may also be configured to control specific lights of the lighting tower 138 based on signals received from the controller 122. As such, the controller 122 of the digital control system 120 may be configured to send signals, via a wired connection 124 and/or via a wireless connection 126, to one or more of the lighting assemblies 130 to achieve the desired beam angle, the desired color, and the desired CCT. Based on the received signals from the controller 122, the lighting assembly controller 136 may output signals to activate individual lights of the lighting tower 138.

The light emitted from specific lights of the lighting tower 138 is reflected off of the PAR 134 and is directed outwardly from the lighting assembly 130. Based upon each specific light's position on the lighting tower 138, the reflected light is directed in a particular direction from the lighting assembly 130. The cumulative reflected light emitted from the lighting assembly 130 converges to generate the desired beam angle.

The user interface 127 may include a button, a keyboard, a mouse, a trackpad, color-tuning controls, zonal lighting controls, and/or the like to enable user interaction with the controller 122. Additionally, the user interface 127 may include an electronic display (not shown) to facilitate providing a visual representation of information, for example, via a graphical user interface ("GUI"), an application interface, text, a still image, and/or video content. The user interface 127 may be a lighting control interface (e.g., digital multiplex ("DMX"), ethernet, Artnet, sACN, Kinet1). In some embodiments, the user interface 127 may be a separate component apart from the controller 122. A user may interact with the user interface 127 to input a particular beam angle, color, and/or CCT of the lighting assemblies 130. Further, if separate beam angles are input to the user interface 127 for individual lighting assemblies 130, the digital control system 120 may be configured to communicate with each individual lighting assembly 130 via unique protocol-specific addresses. For example, a first lighting assembly 130 may have a DMX address of "1," and a second lighting assembly 130 may have a DMX address of "2."

Figure 2:
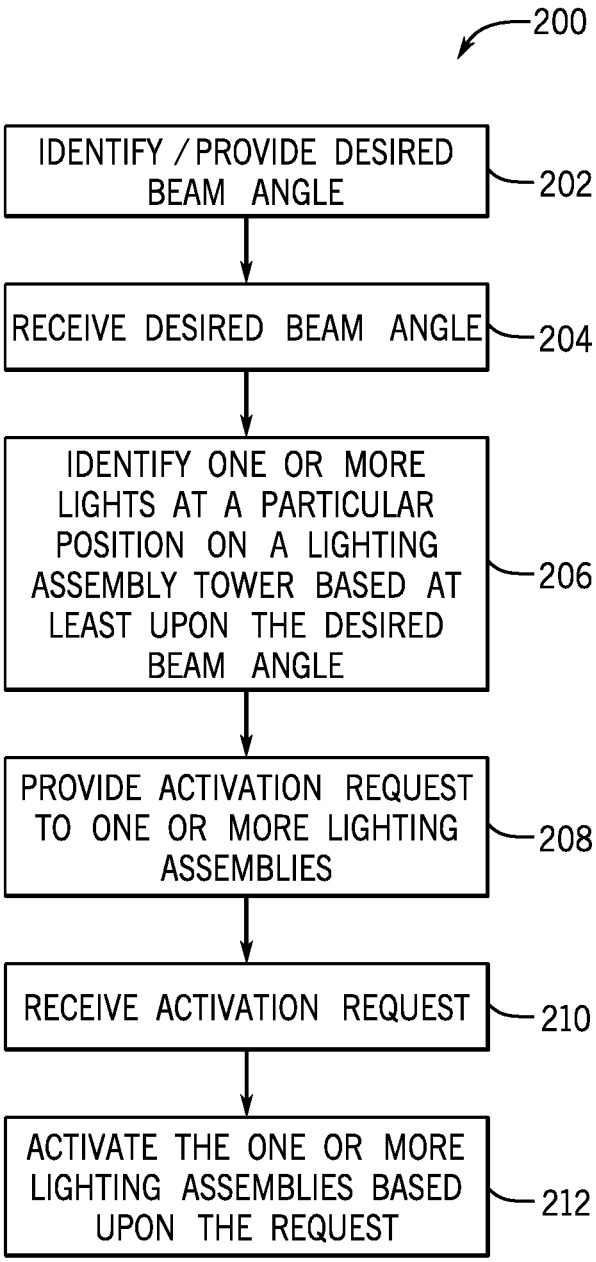
FIG. 2 is a flow diagram depicting a process for adjusting the lighting system of FIG. 1, in accordance with one or more current embodiments.

FIG. 2 illustrates a flow diagram 200 depicting the activity of the lighting system 100 of FIG. 1. Each block of flow diagram 200 (e.g., blocks 202, 204, 206, 208, 210, and 212) may be performed by the digital control system 120 and/or the lighting assembly controller 136. As generally described above, the digital control system 120 may receive an input indicative of a desired beam angle. At block 202, the digital control system 120 may identify and provide the desired beam angle at the user interface 127. For example, based on the specific inputs to the user interface 127, the digital control system 120 may identify the desired beam angle and provide a signal indicative of the desired beam angle. Alternatively, as described below, prior to outputting a signal indicative of the desired beam angle, the digital control system 120 may be configured to identify one or more lights of a lighting assembly 130 to be activated to achieve the desired beam angle.

At block 204, the controller 122 may receive the desired beam angle. For example, a user may provide various inputs to the user interface 127 indicative of a desired beam angle. Those inputs may then be sent from the user interface 127 to the processor 128. In embodiments where block 204 is performed by the lighting assembly controller 136, the lighting assembly controller 136 may receive a signal indicative of the desired beam angle.

At block 206, the controller 122 may identify one or more lights at a particular position on the lighting tower 138 of the lighting assembly 130 based at least upon the desired beam angle. As described in detail below, the lighting tower 138 may include multiple lights disposed along a length of the lighting tower 138. Activation of certain lights may correspond to a certain beam angle. Therefore, based on the desired beam angle, the controller 122 may determine which lights of the lighting tower 138 to illuminate to achieve the desired beam angle. In some embodiments, the controller 136 may be configured to identify one or more lights at a particular position on the lighting tower 138 of the lighting assembly 130 based at least upon the desired beam angle.

At block 208, the controller 122 may provide an activation request to the one or more lighting assemblies 130. For example, the controller 122 may output a signal to a lighting assembly 130 via a wired connection 124 indicative of the specific lights of the lighting tower 138 to activate. In other embodiments, the controller 122 may output a signal to a lighting assembly 130 via a wireless connection 126 indicative of the specific lights of the lighting tower 138 to activate. Further, the lighting system 100 may be configured such that the controller 122 may communicate with the lighting assemblies 130 concurrently via both the wired connection 124 and the wireless connection 126. In some embodiments, the controller 136 may be configured to provide an activation request to the one or more lighting assemblies 130.

At block 210, the lighting assembly controller 136 may receive the activation request. As described above, the activation request may identify individual lights of the lighting tower 138 to activate to achieve the desired beam angle. A signal indicative of the activation request may be received via the wired connection 124, via the wireless connection 126, or via both.

At block 212, the lighting assembly controller 136 is configured to activate the one or more lighting assemblies 130 based upon the activation request. As described above, the activation request may identify specific lights of the lighting tower 138 to activate. The lighting assembly controller 136 may output signals to the lighting tower 138 to activate the specific lights. With this activation of the lights of the lighting tower 138, the desired beam angle may be generated.

Figure 3A:
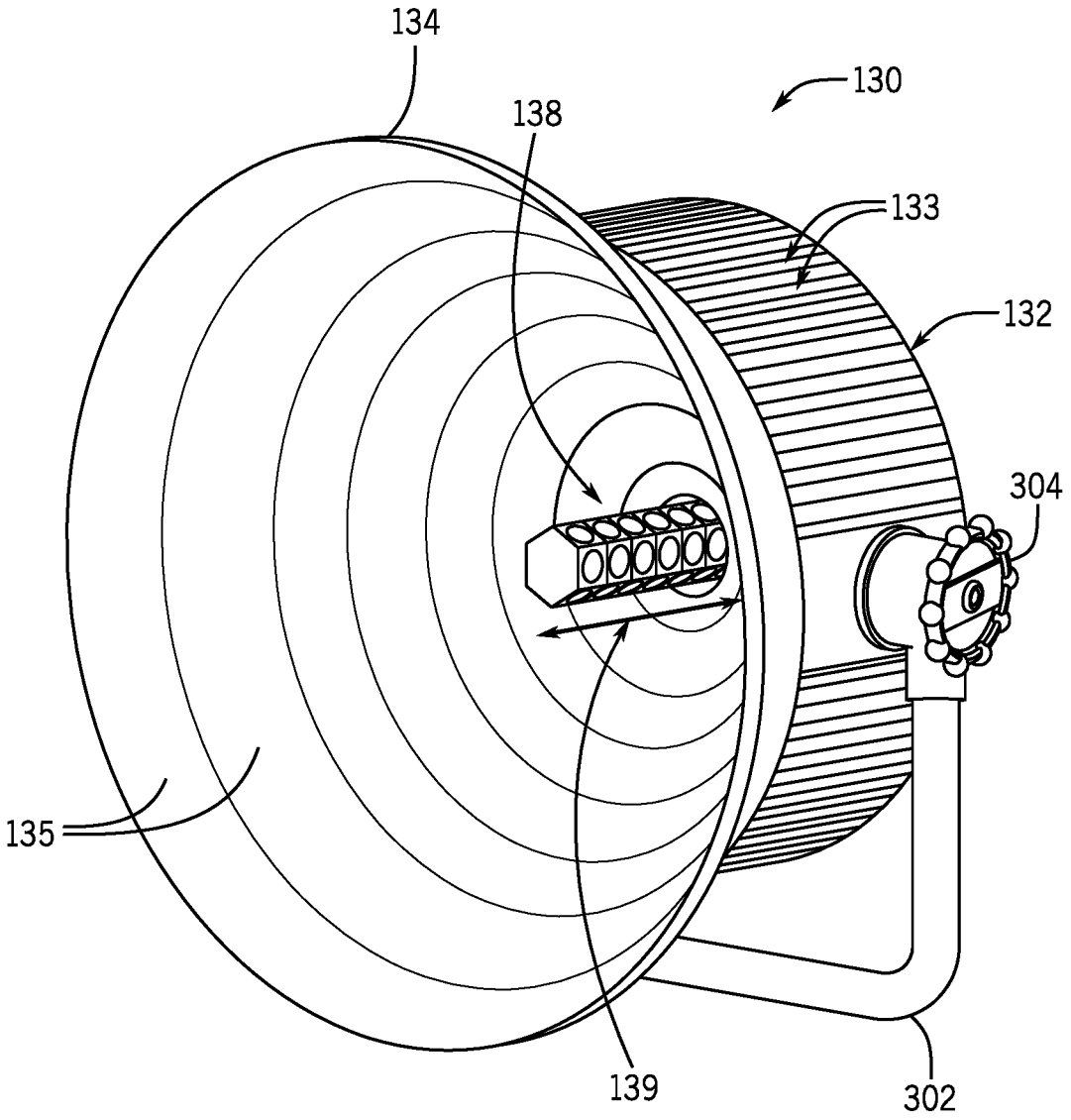
FIG. 3A is a perspective front view of a lighting assembly of the lighting system of FIG. 1, in accordance with one or more current embodiments.

FIG. 3A is a perspective front view of the lighting assembly 130 of the lighting system 100 of FIG. 1. As illustrated, the lighting assembly 130 includes the chassis 132, the PAR 134, the lighting tower 138, and an optional stand 302 and rotation handle 304. Although not illustrated, the lighting assembly 130 may further include the lighting assembly controller 136 configured to control various operations of the lighting assembly 130. In certain embodiments, the lighting assembly 130 may include support structures other than or in addition to the stand 302 and/or the rotation handle 304. In such embodiments, the lighting assembly 130 may be coupled to or suspended from a lighting rig, coupled to another type of stand, or coupled to other components configured to support the lighting assembly 130.

The lighting tower 138 is fixed relative to the chassis 132 and the PAR 134. In traditional lighting systems using a parabolic optic, to adjust a beam angle, a bulb disposed in the parabolic optic is moved 2-3 inches relative to the parabolic optic using a mechanical actuator. For the lighting assembly 130, instead of moving the light source, the activated LEDs (e.g., the activated lighting elements of the illustrated embodiment) change, altering the location of the source of the light digitally by simply selecting different LEDs of the lighting tower 138 to illuminate. By lighting more LEDs in different locations, the lighting assembly 130 has more flexibility to change the beam shape. This can be performed with chip-on-board configurations ("COBs"), discrete LEDs, or a combination of the two. As described in reference to FIG. 4, which illustrates one lighting tower embodiment, the lighting tower 138 includes multiple LED light source layers extending in a direction indicated by reference numeral 139. The LED light source layers are configured to activate and illuminate independently of one another. Accordingly, to adjust the beam angle to another desired beam angle, the location of activated LEDs may be adjusted by non-mechanical means. For example, to achieve a desired beam angle, only a portion of the LED light source layers may be illuminated. Additionally, all of the LED light source layers may be illuminated. By including LEDs in the lighting tower 138, the system may achieve longer working lifespans (~50,000 hours) compared to traditional lighting systems. While LEDs are described in the embodiments of the present disclosure, it is appreciated that the present disclosure is not restricted to the use of LEDs as lighting elements. Other light sources, for example laser diodes, may be used and a significant proportion of the benefits of the present disclosure may be achieved.

The light emitted by the lighting tower 138 is projected radially from the lighting tower 138 toward interior rings 135 of the PAR 134. In some instances, the lighting tower 138 may be configured to provide dynamically changeable CCTs and/or colors. The PAR 134 includes the interior rings 135 to blend light emitted by the LEDs (various CCTs and colors). For example, some LED light sources may be configured to emit light at a first CCT and/or color, and other LED light sources may be configured to emit light at a second CCT and/or color. Further, the CCT and the color may each be independently controlled at the light sources. Light directed toward the PAR 134 from the lighting tower 138 is then reflected outward by the PAR 134 in a direction opposite the chassis 132. As illustrated, the interior rings 135 are concentric about the lighting tower 138. The interior rings 135 of the PAR 134 closer to the chassis 132 are smaller in diameter than interior rings further from the chassis 132. As such, an interior surface of the PAR 134 forms a parabola extending from an interior ring 135 having the smallest diameter (e.g., the interior ring 135 closest to the chassis 132) to an interior ring having the largest diameter (e.g., the interior ring 135 farthest from the chassis 132). The parabolic shape of the PAR 134 allows light reflected by the PAR 134 to focus at a focal point in front of the lighting assembly 130. The specific focal point may correspond to a specific beam angle. Thus, a desired beam angle may correspond to a desired focal point.

The lighting assembly 130 is also configured to conduct heat more efficiently than traditional lighting systems. Because the chassis 132, the PAR 134, and the lighting tower 138 are stationary relative to one another, heat generated by the lighting tower 138 may be conducted to the chassis 132 and the PAR 134. As described above, in traditional lighting systems, a bulb disposed at the center of a parabolic optic is configured to move relative to the parabolic optic and/or relative to the base. This movement means the bulb is not rigidly coupled to the parabolic optic and/or to the base, so heat transfer between the bulb and the rest of a parabolic optic may be inefficient.

Because the chassis 132 and the PAR 134 are fixed relative to the lighting tower 138, the chassis 132 and/or the PAR 134 may be configured to act as a heat sink for the lighting assembly 130. For example, heat transfer and heat dissipation from the lighting tower 138 may be enhanced based on the material and structure of the chassis 132 and the PAR 134. For example, the chassis 132 and the PAR 134 may be constructed using aluminum, which is one of the highest efficiency reflectors (up to 97%) as well as one of the most thermally conductive metals. In this manner, the components of the lighting assembly 130 create a thermal circuit that integrates the surface area of the chassis 132 and the PAR 134 for use as a large surface area heat sink for the lighting tower 138.

In some embodiments, noise from fans may be undesirable in motion picture and television equipment. This multipurpose heat sink/optic/housing enables reduced weight and can eliminate the need for such fans, resulting in reduced noise and reduced manufacturing costs.

In some embodiments, additional heat distribution may be desired. Accordingly, in the embodiment of FIG. 3A, fins 133 are added to the chassis 132 and may be added to the exterior of the PAR 134 to increase the surface area of the heat sink capability. Heat may be dissipated through the surface area via clean cool air reacting with the heat distributed to the fins.

Thermal cooling may further be enhanced with the inclusion of heat pipes in (or adjacent to) the lighting tower 138 and/or the chassis 132. The heat pipes may be embedded in a core of the lighting tower 138 and may be used to move heat efficiently from the lighting tower 138 to the chassis 132 and/or the PAR 134. To facilitate heat transfer, the heat pipes may be made of copper. The heat pipes may make a thermal circuit that connects the lighting tower 138 thermally to the chassis 132. Because the lighting tower 138 and the chassis 132 are fixed relative to one another, the heat pipes may extend through the lighting tower 138 and into the chassis 132. In the chassis 132, the heat pipes may extend radially outward from the lighting tower 138 to form "L" shapes. For example, the lighting assembly 130 may include four individual heat pipes extending through the lighting tower 138 and into the chassis 132. Each heat pipe may extend radially outward.

In traditional lighting systems, because a bulb is moved relative to another housing portion, heat pipes or similar forms of heat transfer may be impractical. With the lighting assembly 130, heat transfer may be enhanced with the inclusion of heat pipes. The heat pipes may include distilled water in a vacuum. The distilled water may experience phase changes within the heat pipes to facilitate heat transfer. For example, water in a portion of a heat pipe in the lighting tower 138 may be a vapor. As the vapor travels down the heat pipe toward the chassis 132, the temperature may decrease and the vapor may change to liquid in the chassis 132. Example embodiments of lighting towers having heat pipes are provided below in reference to FIGS. 11A, 11B, and 12.

Figure 6A:
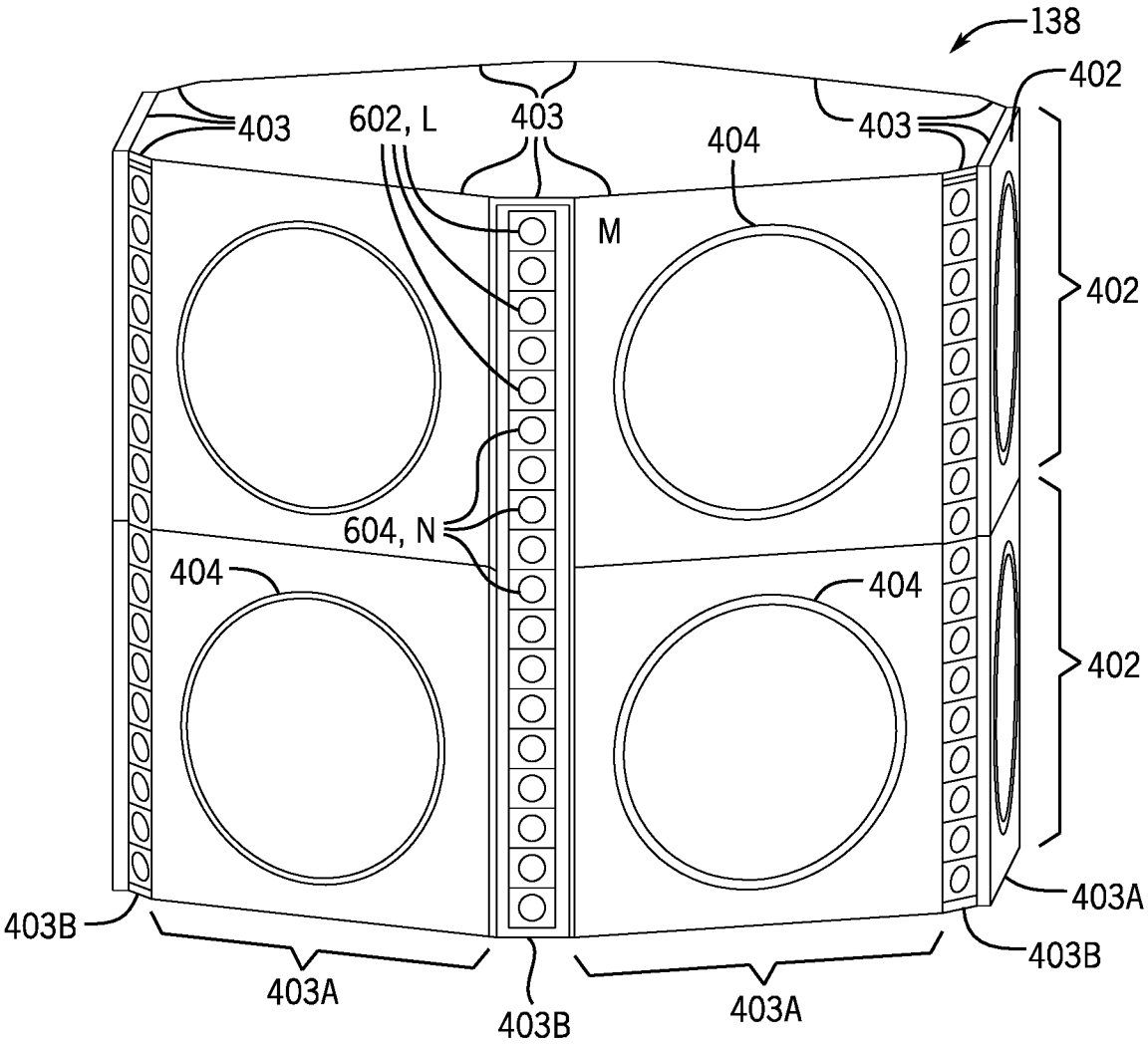
FIG. 6A is an illustration of a lighting tower of the lighting system of FIG. 1 with CCT tuning capabilities, in accordance with one or more current embodiments.

The sizes of both the lighting tower 138 and the PAR 134 may be proportional to one another and may vary. The lighting tower 138 may be 15 mm in length, as generally indicated by arrow 139. Etendue, a property of light that characterizes the distribution of light for an area and an angle, implies that a light source and a reflector may be proportional to one another to generate light for a specific area and a specific angle. For example, in an exemplary embodiment, a light source (e.g., base light source 404, first supplementary light source 602, and second supplementary light source 604 described below and as shown in FIG. 6A) may also be proportional to the PAR 134. A light source that is 50 mm in diameter may correspond to a reflector (e.g., the PAR 134) 435 mm in diameter. A light source 70 mm in diameter may correspond to a reflector 610 mm in diameter. Additionally, a light source 100 mm in diameter may correspond to a reflector 870 mm in diameter.

Figure 3B:
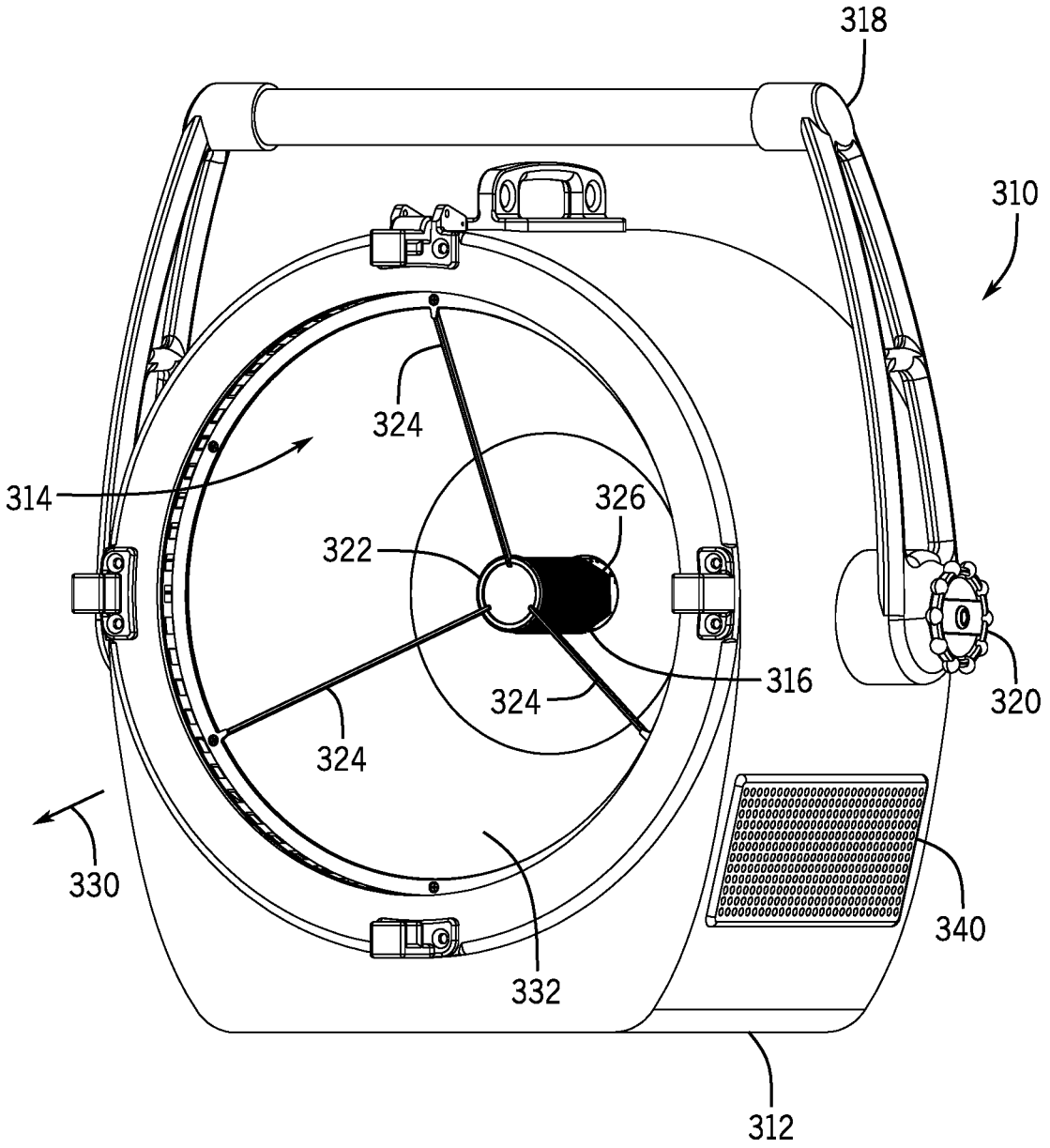
FIG. 3B is a perspective front view of a lighting assembly of the lighting system of FIG. 1, in accordance with one or more current embodiments.

FIG. 3B is a perspective front view of a lighting assembly 310 that may be employed within the lighting system 100 of FIG. 1. As illustrated, the lighting assembly 310 includes a chassis 312, a PAR 314, a lighting tower 316, and an optional stand 318 and rotation handle 320. Although not illustrated, the lighting assembly 310 may further include the lighting assembly controller 136 configured to control various operations of the lighting assembly 310. In certain embodiments, the lighting assembly 310 may include support structures other than or in addition to the stand 318 and/or the rotation handle 320. In such embodiments, the lighting assembly 310 may be coupled to or suspended from a lighting rig, may be coupled to another type of stand, may rest on the ground or another surface, or may be coupled to other components configured to support the lighting assembly 310.

As illustrated, the lighting tower 316 is positioned generally at a center of the PAR 314. The lighting tower 316 is coupled to the chassis 312 at a first end 322 via supports 324, which extend from the first end 322 to the chassis 312. Additionally, a second end 326 of the lighting tower 316 (e.g., a base of the lighting tower 316) is coupled to the PAR 314. As such, the PAR 314, the supports 324, and other portions of the lighting assembly 310 may structurally support the lighting tower 316 within the lighting assembly 310.

As described in greater detail below, the lighting tower 316 includes layers of chip scale packaging arrays ("CSP" arrays) having multiple LEDs. The CSP arrays are configured to activate and illuminate independently of one another. Accordingly, to adjust the beam angle to another desired beam angle, the activated CSP arrays may be adjusted by non-mechanical means. For example, to achieve a desired beam angle, only a portion of the CSP arrays, at one or more predetermined locations, may be illuminated. Additionally, all of the CSP arrays may be illuminated. By including the LEDs of the CSP arrays in the lighting tower 316, the system may achieve longer working lifespans compared to traditional lighting systems. As explained previously, the lighting elements need not be restricted to the LEDs in this embodiment, and other forms of lighting elements may be used.

The light emitted by the lighting tower 316 is projected radially from the lighting tower 316 toward the PAR 314. In some instances, the lighting tower 316 may be configured to provide dynamically changeable CCTs and/or colors. The PAR 314 may blend light emitted by the LEDs (various CCTs and colors). For example, some LED light sources may be configured to emit light at a first CCT and/or color, and other LED light sources may be configured to emit light at a second CCT and/or color. Further, the CCT and the color may each be independently controlled at the light sources. Light directed toward the PAR 314 from the lighting tower 316 is then reflected outward by the PAR 314 in a direction opposite the chassis 312, as indicated by arrow 330.

The lighting assembly 310 may also include safety glass 332 coupled to the chassis 312 and positioned outwardly from the lighting tower 316. The safety glass 332 may substantially prevent a user from touching the PAR 314 and/or the lighting tower 316, which may become hot during operation. Additionally or alternatively, the safety glass 332 may substantially prevent debris (e.g., water, dust, insects, etc.) from entering the lighting assembly 310 to provide a clean operating environment for the lighting tower 316. As described in further detail below, a positioning of vents 340 of the lighting tower 316 may also protect from water intrusion. In certain embodiments, the lighting tower 316 may have an Ingress Protection Rating of IP33. For example, the lighting tower 316 may be protected from tools and wires greater than 2.5 millimeters ("mm"), as well as water spray at an angle up to 60 degrees from vertical, from entering an interior of the lighting tower 316.

The lighting assembly 310 is also configured to efficiently conduct heat. Because the chassis 312, the PAR 314, and the lighting tower 316 are stationary relative to one another, heat generated by the lighting tower 316 may be conducted to the chassis 312 and the PAR 314. As such, the chassis 312 and/or the PAR 314 may be configured to act as a heat sink for the lighting assembly 310. For example, heat transfer and heat dissipation from the lighting tower 316 may be enhanced based on the material and structure of the chassis 312 and the PAR 314. The chassis 312 and the PAR 314 may be constructed using aluminum, which is one of the highest efficiency reflectors (up to 97%) as well as one of the most thermally conductive metals. In this manner, the components of the lighting assembly 310 create a thermal circuit that integrates the surface area of the chassis 312 and the PAR 314 for use as a large surface area heat sink for the lighting tower 316. The heat exchange of the lighting assembly 310 may further be enhanced via active cooling, as described in greater detail in reference to FIGS. 10A and 10B. For example, the vents 340 may enable air flow into the lighting assembly 310 to actively cool the lighting assembly 310.

Figure 4:
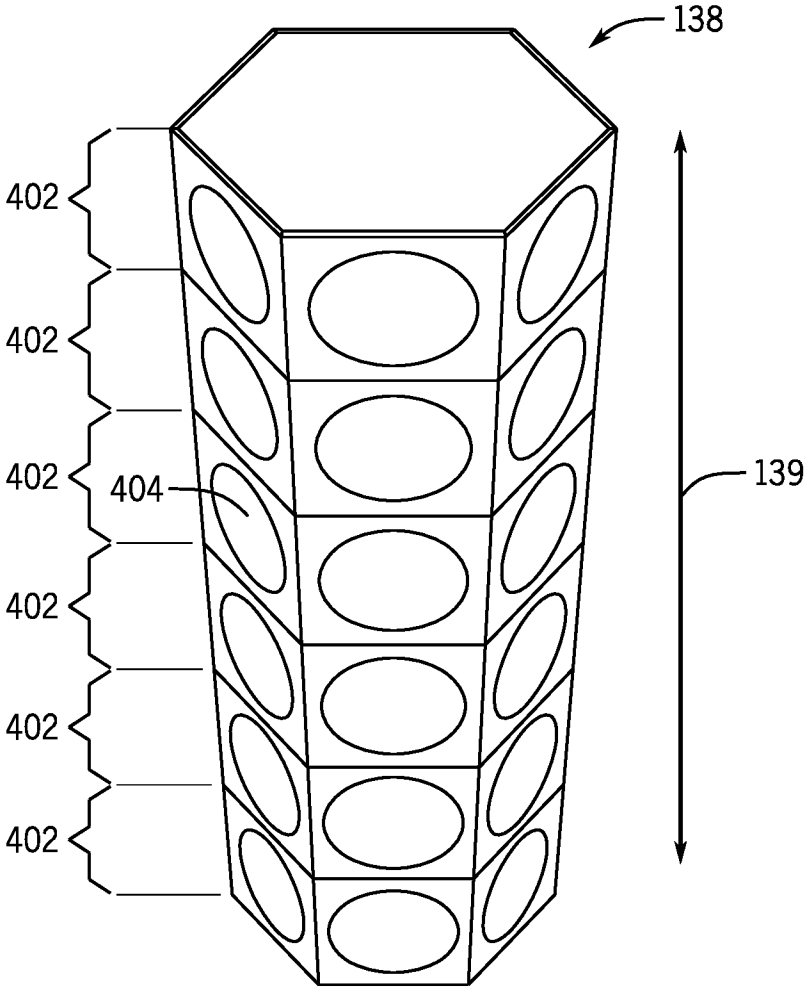
FIG. 4 is a perspective view of a lighting tower of the lighting assembly of FIG. 3A, in accordance with one or more current embodiments.

FIG. 4 is a perspective view of the lighting tower 138 of the lighting assembly 130 of FIG. 3A. The lighting tower 138 may include light source layers 402 with base light sources (e.g., lighting elements) 404 disposed on each side of the tower at the respective light source layers 402. The light source (e.g., lighting element) layers generally extend in the direction 139, as previously illustrated in FIG. 3A. In the illustrated embodiment, the lighting tower 138 includes 6 light source layers 402 (or levels of light sources). However, in some embodiments, the lighting tower may include more or less light sources layers 402 (e.g., 2 layers, 3 layers, 4 layers, 5 layers, 7 layers, 8 layers, etc.). Additional layers may provide more granularity in beam angle adjustment, while a reduced number of layers may provide certain sizing or cost efficiencies. Further, in the illustrated embodiment, each light source layer 402 includes 6 sides with a single base light source 404 disposed on each side. However, in some embodiments, each light source layer 402 may include more or less sides (e.g., 3 sides, 4 sides, 5 sides, 7 sides, 8 sides, etc.). An increased number of sides may result in increased light intensity, while a decreased number of sides may also provide certain sizing or cost efficiencies. In certain embodiments, each side of each light source layer 402 may include additional light sources (e.g., 2 light sources, 3 light sources, 4 light sources, 5 light sources, etc.). The lighting tower 138 may also be a cylindrical shape such that there are no distinct sides. For example, curved LEDs (e.g., LEDs with a curved lighting emitting surface) could be used within each light source layer 402.

Each base light source (lighting element) 404 may include a single LED or multiple LEDs. For example, each base light source 404 may include multiple LEDs in a COB configuration, as discrete LEDs, or a combination of COBs and discrete LEDs. In some embodiments, the LEDs may be configured in CSP configurations. In CSP configurations, LEDs may be disposed directly on electronic circuitry of the lighting tower 138. Additionally, while each base light source 404 is illustrated as a circle occupying a majority of the surface area of each side of each lighting source layer 402, each base light source 404 may a different size and/or a different shape. For example, the lighting tower 138 may include base light sources 404 of different sizes and/or different shapes (e.g., triangles, squares, pentagons, hexagons, etc.).

The lighting tower 138, combined with the PAR 134, significantly increases the number of LEDs that can be fit into a small source size, because the lighting tower 138 emits the light laterally. For example, in the illustrated embodiment, light is emitted from 6 vertical sides. Using a side emission tower allows for 5 times or greater LEDs to be placed into the same three-dimensional space. The lighting assembly 130 may generate a brighter LED light in a more compact fixture compared to traditional, flat, and planer LED sources that emit light in only one direction. Because the PAR 134 may redirect lateral light emitted by the lighting tower 138, the lighting assembly 130 leverages that reflector capability and may include LEDs on all sides of the lighting tower 138. In an aspect, the ability to digitally control which lighting source layer 402 is to be turned on creates a motionless focused beam LED light, eliminating the need for a focus knob (because the beam angle may be controlled using DMX controls) and a moving lamp.

Figure 5A:
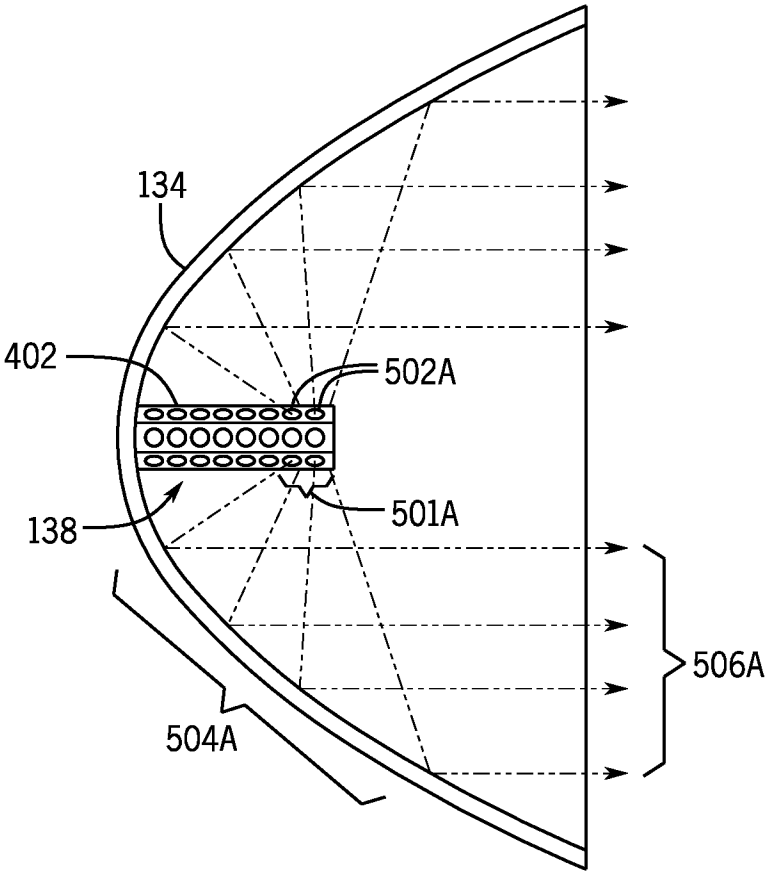
FIGS. 5A-5C are diagrams of lighting angles that may be generated by the lighting system of FIG. 1, in accordance with one or more current embodiments.
Figure 5C:
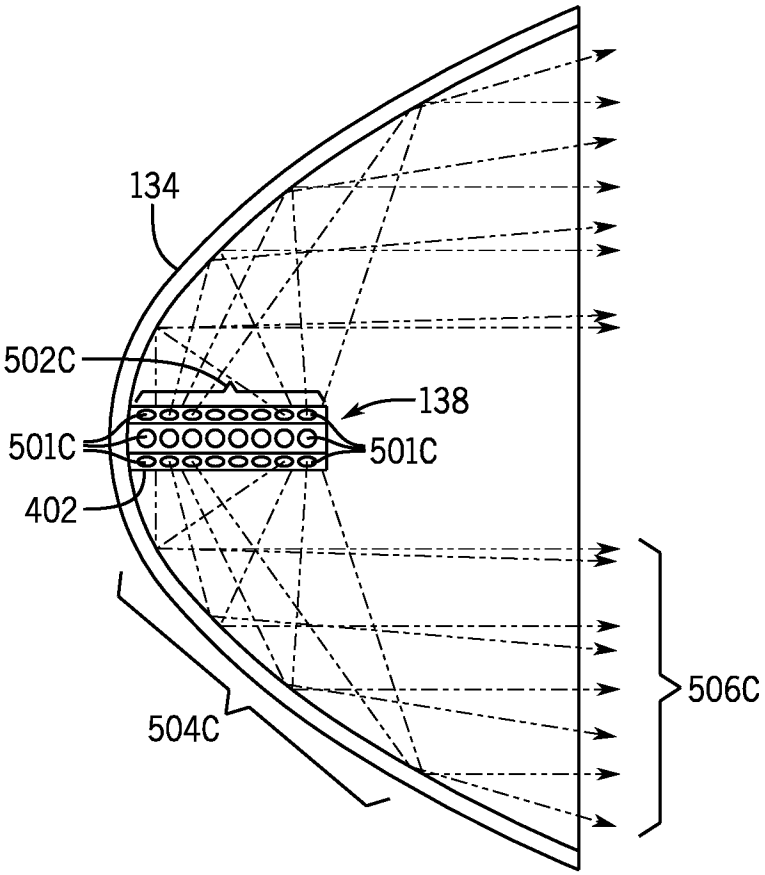
Figure 5B:
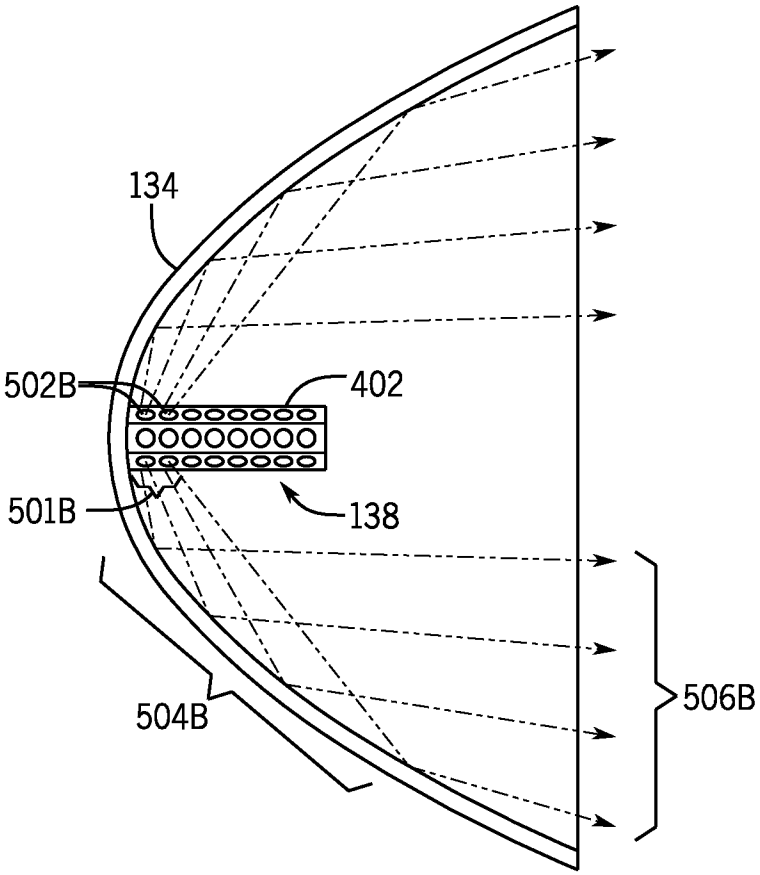

FIGS. 5A-5C illustrate lighting angles that may be generated by the lighting system 100 of FIG. 1. As described above, the lighting tower 138 includes multiple light source layers 402 that may be selectively activated to generate various beam angles. In the embodiment of FIG. 5A, two light source layers 501A are activated, as indicated by illuminated layer lights 502A. The two activated light source layers 501A are the light source layers disposed furthest from the PAR 134. Light emitted from the activated light source layers 501A is projected radially outward toward the PAR 134, as generally indicated by arrows 504A. The light is then reflected by the PAR 134 and redirected as indicated by arrows 506A. The activated light source layers 501A are generally positioned at a focal point of the PAR 134 such that the beams of light reflected by the PAR 134 (e.g., arrows 506A) are generally parallel and generate a focused beam angle. The light indicated by arrows 506A may be directly toward a target.

FIG. 5B illustrates two activated light source layers 501B positioned at a portion of the lighting tower 138 closest to the PAR 134, as indicated by illuminated layer lights 502B. Light emitted from the activated light source layers 501B is projected radially outward toward the PAR 134, as generally indicated by arrows 504B. The light is then reflected by the PAR 134 and redirected as indicated by arrows 506B. The activated light source layers 501B are generally positioned close to the PAR 134 such that the beams of light reflected by the PAR 134 (e.g., arrows 506B) generate a wider pattern of light and a wide beam angle.

FIG. 5C illustrates the lighting tower 138 with every light source layer 402 as an activated light source layer 501C, as indicated by illuminated layer lights 502C. Light emitted from the activated light source layers 501C is projected radially outward toward the PAR 134, as generally indicated by arrows 504C. The light is then reflected by the PAR 134 and redirected as indicated by arrows 506C. By activating all the light source layers 402, a more varied and wider beam angle and shape may be generated. While the illustrated embodiments of FIGS. 5A-5C include only ends of the lighting tower 138 activated or the entire lighting tower 138 activated, it should be appreciated that other portions of the lighting tower 138 may be activated independent of one another (e.g., only a middle portion of the lighting tower 138 may be activated, two-thirds of the lighting tower 138 may be activated, activating one or more sides of all the light source layers simultaneously, etc.).

Figure 5D:
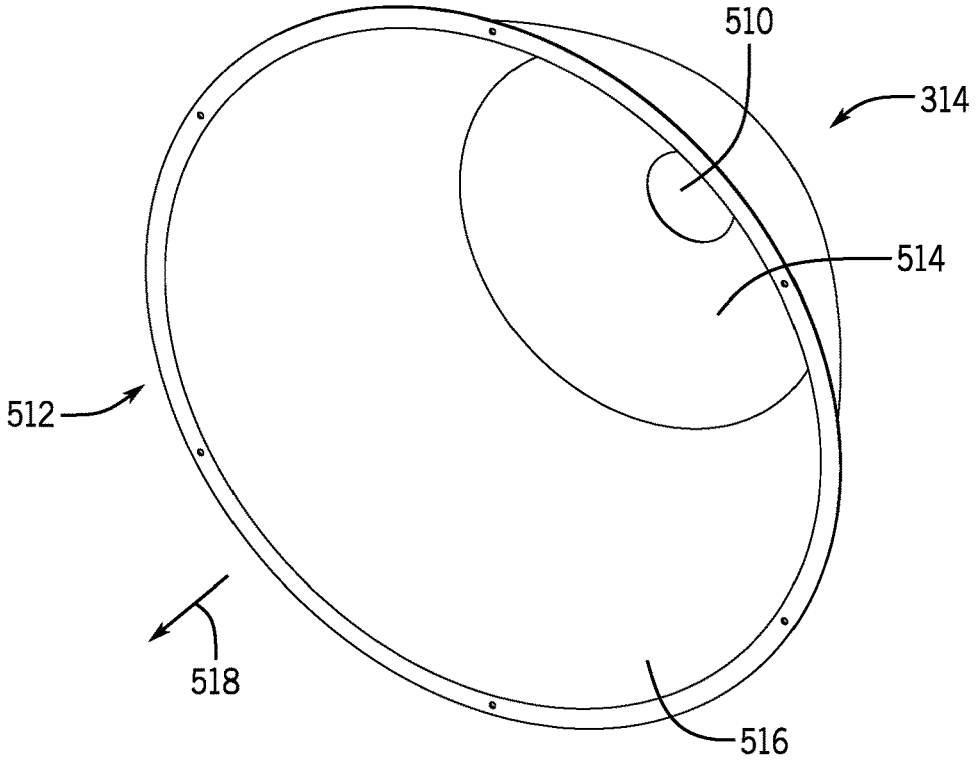
FIG. 5D is a perspective view of a reflector of the lighting assembly of FIG. 3B, in accordance with one or more current embodiments.

FIG. 5D is a perspective view of the PAR 314 of the lighting assembly 310 of FIG. 3B. As illustrated, an opening 510 is formed within the PAR 314 through which the lighting tower 316 may extend. For example, the lighting tower 316 may extend from the opening 510 and into an interior 512 of the PAR 314. The PAR 314 includes an inner ring 514 and an outer ring 516 configured to reflect light emitted from the lighting tower 316 generally in a direction 518. For example, light emitted generally radially by the lighting tower 316 may be reflected and redirected by the inner ring 514 and the outer ring 516 in the direction 518 to provide a desired beam angle and/or light pattern. In certain embodiments, the PAR 314 may include more or fewer rings (e.g., one ring, three rings, four rings, ten rings, etc.).

Figure 5E:
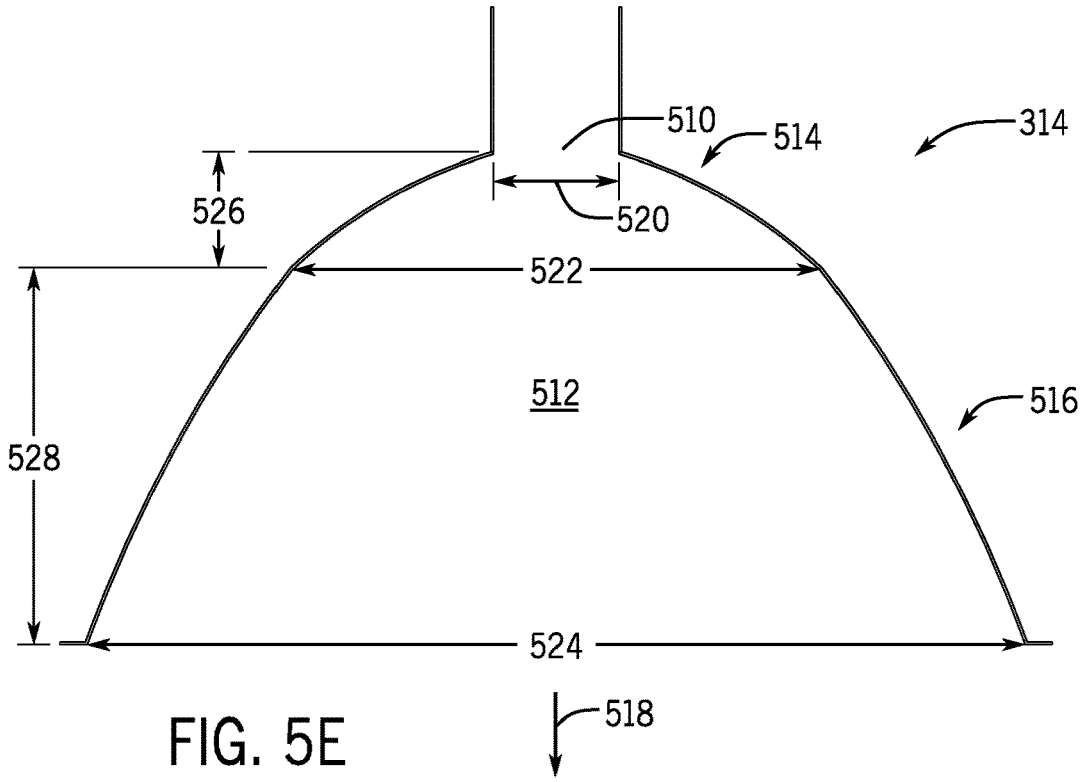
FIG. 5E is a cross-sectional view of the reflector of FIG. 5D, in accordance with one or more current embodiments.

FIG. 5E is a cross-sectional view of the PAR 314 of FIG. 3B. As illustrated, the inner ring 514 is generally smaller than the outer ring 516 in both diameter and length. An inner diameter 520 of the inner ring 514 (e.g., a diameter adjacent to the opening 510 or a diameter of the opening 510) may be about 60 mm, and an outer diameter 522 of the inner ring 514 (or an inner diameter of the outer ring 516) may be about 247 mm. An outer diameter 524 of the outer ring 516 may be about 450 mm. Additionally, a length 526 (or height) of the inner ring 514 between the opening 510 and the outer ring 516 may be about 55 mm, and a length 528 (or height) of the outer ring 516 extending from the inner ring 514 may be about 180 mm. In other embodiments, the diameter 520, the diameter 522, the diameter 524, the length 526, the length 528, or a combination thereof, may be other suitable dimensions to enable the PAR 314 to reflect light from the lighting tower 316 in the direction 518 to provide a desired beam angle and/or light pattern.

Figure 5F:
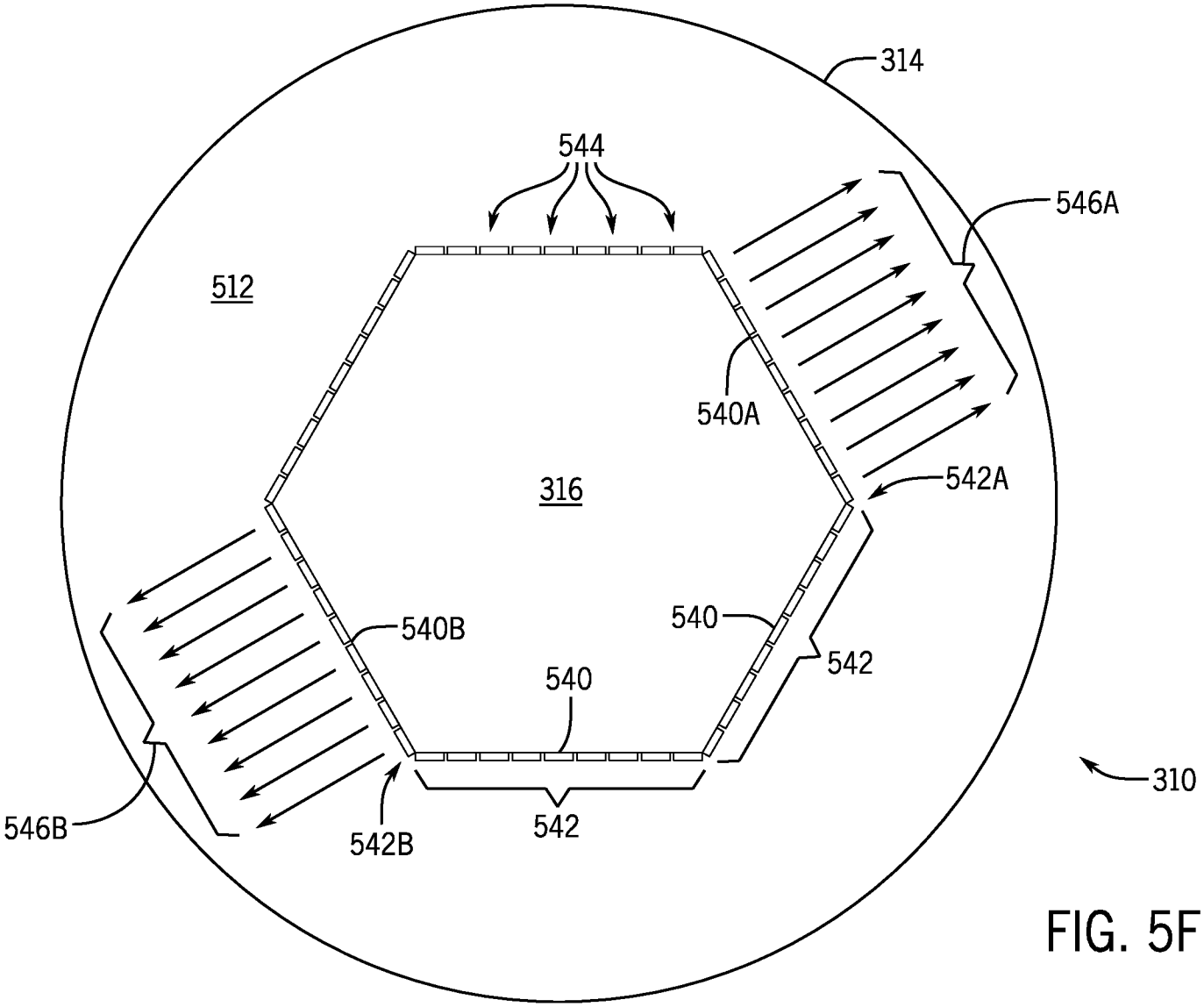
FIG. 5F is a front view of the lighting assembly of FIG. 3B, in accordance with one or more current embodiments.

FIG. 5F is a front view of the lighting assembly 310 of FIG. 3B with the lighting tower 316 positioned within the interior 512 of the PAR 314. As illustrated, the lighting tower 316 includes a hexagonal shape that may extend within the interior 512 of the PAR 314. As such, the lighting tower 316 includes six sides 540 with each side 540 coupled to one or more layers of CSP arrays 542 (e.g., the CSP arrays 542 may be mounted to the sides 540 or may be integral to the sides 540). In certain embodiments, the lighting tower 316 may include more or fewer sides 540 (e.g., three sides 540, four sides 540, seven sides 540, ten sides 540, etc.) with some or all of the sides 540 coupled to the layer(s) of CSP arrays 542. Accordingly, each layer of lighting elements is positioned about a longitudinal axis of the lighting tower 316, and in at least one embodiment, this provides 360 degrees of potential illumination by the lighting tower 316.

The CSP arrays 542 include rows of LED's 544 configured to emit light of varying temperatures (e.g., CCT's) and colors. As such, the sides 540 of the lighting tower 316, certain layers of the CSP arrays 542, individual CSP arrays 542, or a combination thereof, may be controlled to emit light and provide a desired beam angle and/or light pattern when reflected by the PAR 314. In the illustrated embodiment, a first CSP array 542A positioned on a first side 540A and a second CSP array 542B positioned on a second side 540B are emitting light, as indicated by arrows 546A and 546B, respectively. The light emitted by the LED's 544 of the CSP arrays 542A and 542B is projected radially outward from the lighting tower 316 and toward the PAR 314. The PAR 314 may reflect the light outwardly from the lighting assembly 310.

In certain embodiments, other CSP arrays 542 along other respective sides 540 may be controlled to emit light. For example, the CSP arrays 542 on two adjacent sides 540 may be controlled to emit light (turned on), while the remaining CSP arrays 542 on the remaining sides 540 may be controlled to not emit light (turned off). In another example, the CSP arrays 542 on all sides 540 may be controlled to emit light, or only three, four, or five of the CSP arrays 542 on three, four, or five respective sides 540 may be controlled to emit light. As such, the lighting tower 316 may be controlled to emit light in varying directions, symmetrically, and asymmetrically. As described in greater detail below, individual layers of the CSP arrays 542 on the sides 540 may also be controlled to emit light. As such, the CSP arrays 542 on each side 540, along with the individual layers of CSP arrays 542 may be controlled to emit light and provide a desired beam angle and/or light pattern when reflected by the PAR 314. Each CSP array 542 may also be controlled with independent color and independent CCT settings.

Figure 5G:
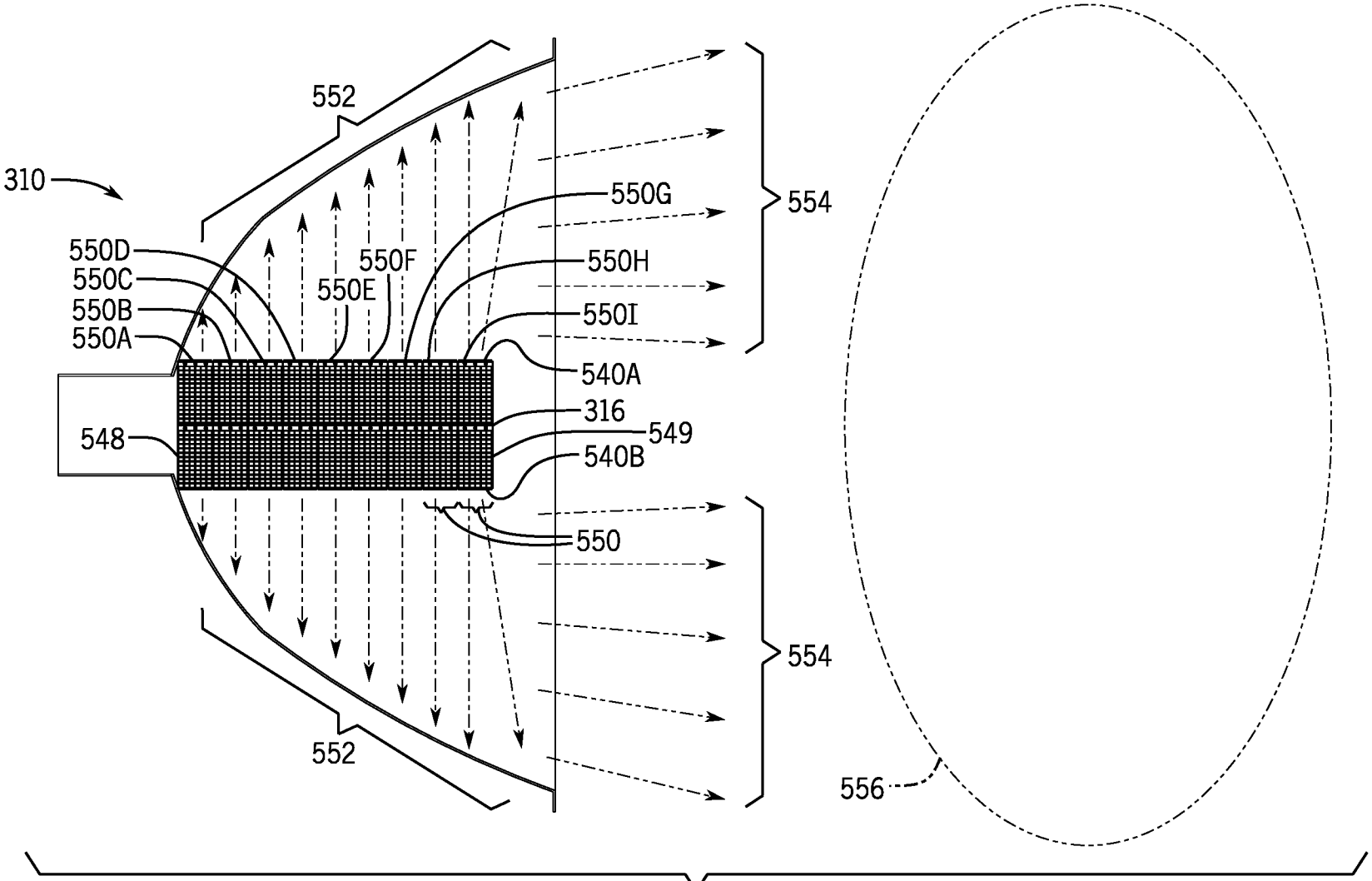
FIGS. 5G-5I are diagrams of lighting angles and lighting patterns that may be generated by the lighting system of FIG. 1, in accordance with one or more current embodiments.
Figure 5H:
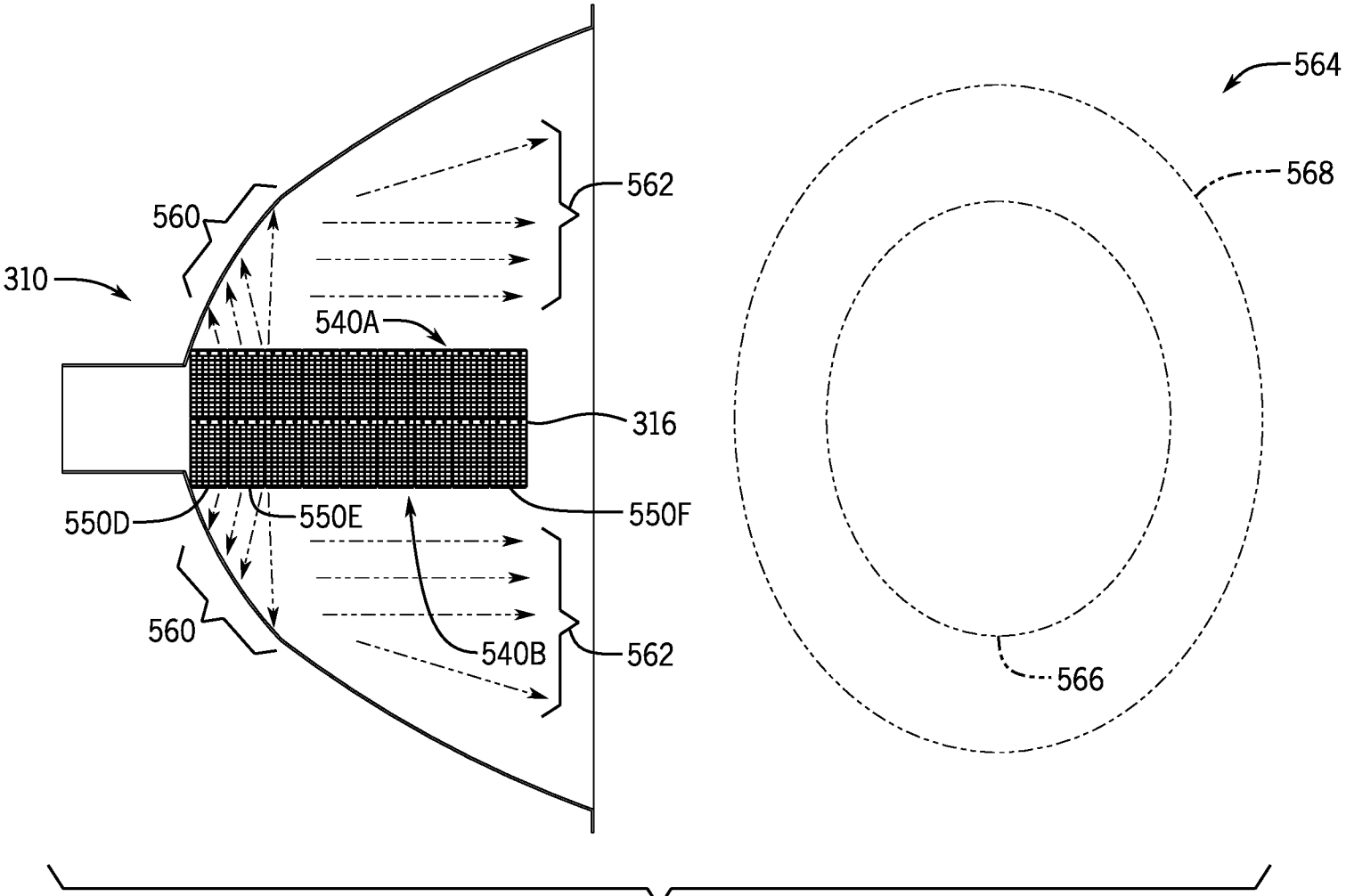
Figure 5I:
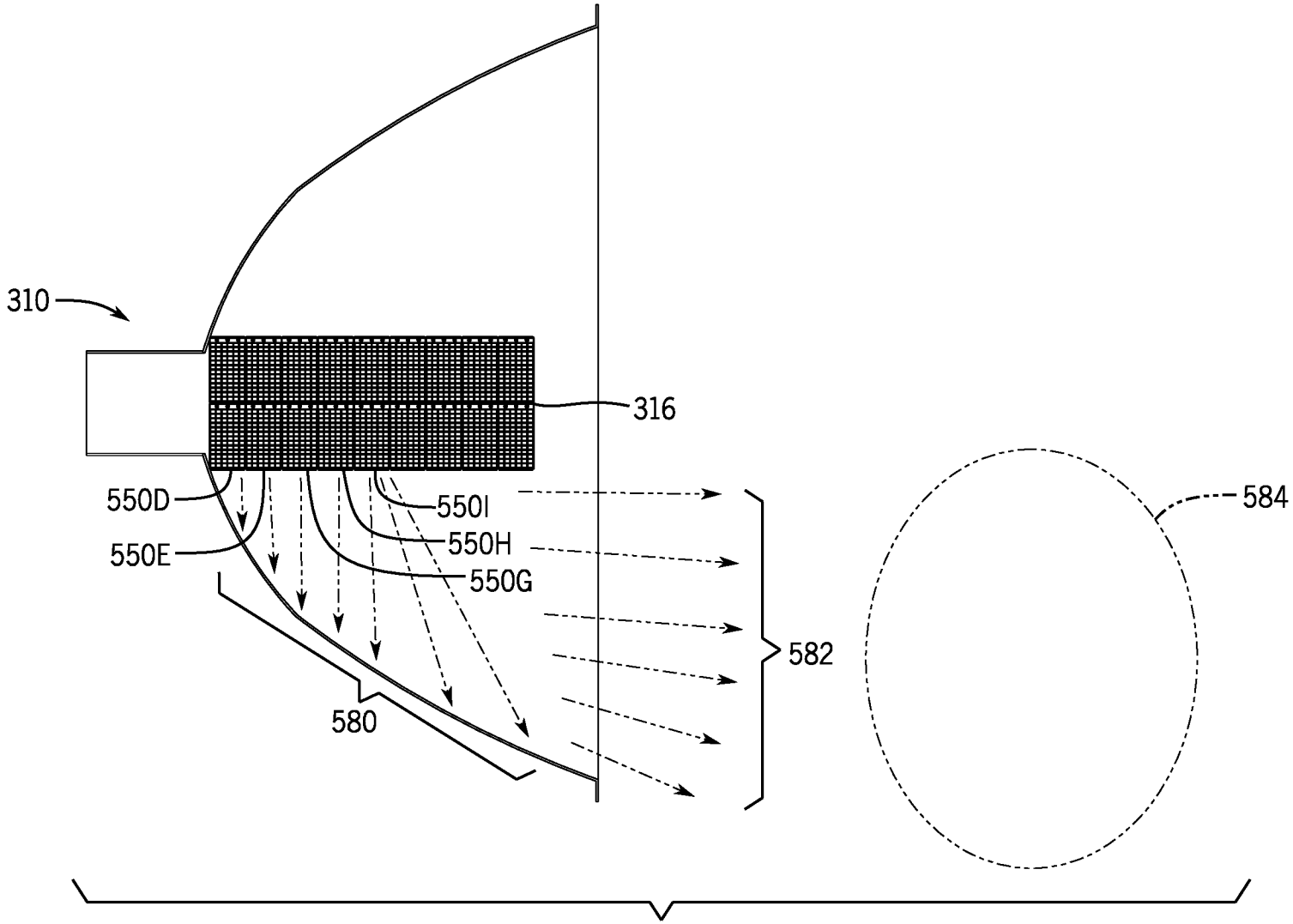

FIGS. 5G-5I are diagrams of lighting angles and lighting patterns that may be generated by the lighting system 100 of FIG. 1. As illustrated in FIG. 5G, the lighting tower 316 includes light source layers 550 disposed along the length of the lighting tower 316 that may be selectively activated to generate various beam angles and/or lighting patterns. Each light source layer 550 extends around the lighting tower 316 and includes a single CSP array 542 on each side 540. The illustrated embodiment of the lighting tower 316 includes nine light source layers 550. In certain embodiments, the lighting tower 316 may include more or fewer light source layers 550 per side (e.g., one light source layer 550, two light source layers 550, four light source layers 550, ten light source layers 550, twenty light source layers 550, etc.) and a different number of sides (e.g., 2 sides, 4 sides, 6 sides, 8 sides, 10 sides, 13 sides, 21 sides, etc.).

Each side 540 of CSP arrays 542, each light source layer 550 of CSP arrays 542, and each individual CSP array 542 may be individually controlled to generate a desired beam angle, a desired CCT, and/or a desired color. For example, adjusting which light source layers 550 are illuminated and the intensity of light provided by the illuminated light source layers 550 allows for adjustment to the desired beam angle. Additionally, adjusting which light source layers 550 are illuminated and the intensity at which each light source layer 550 is illuminated allows for varying CCT's to be generated. In general, illuminating and/or activating only the light source layers 550 at a base 548 of the lighting tower 316 adjacent to the PAR 314 (e.g., the bottom two or three light source layers 550) allows for a relatively small beam angle. As more light source layers 550 are illuminated along the length of the lighting tower 316 (e.g., toward a top 549 of the lighting tower 316), the beam angle may increase. As such, controlling the illumination and light intensity of each light source layer 550 allows for varying beam angles and varying CCT's related to certain lighting effects. For example, a large beam angle with a high CCT (e.g., a warm CCT) that may provide an appearance similar to a positive, inviting character, such as an angel. A small beam angle with a low CCT (e.g., a cool CCT) may provide an appearance of a cold, harsh character, such as a vampire.

By way of specific example, to provide a beam angle of fifteen degrees, light source layers 550A and 550B adjacent to the base 548 of the lighting tower 316 may be illuminated to a first intensity, and light source layer 550C (e.g., a third light source layer 550 from the base 548) may be illuminated to a second intensity that is about half of the first intensity. To provide a beam angle of twenty degrees, the light source layers 550B and 550C may be illuminated to a first intensity, and the light source layer 550A may be illuminated to a second intensity that is about thirty percent of the first intensity. To provide a beam angle of thirty degrees, the light source layers 550B and 550C may be illuminated to a first intensity, light source layer 550D may be illuminated to a second intensity that is about forty percent of the first intensity, and the light source layer 550A may be illuminated to a third intensity that is about thirty percent of the first intensity. To provide a beam angle of forty degrees, light source layers 550B, 550C, 550D, 550E, and 550F may be illuminated to a first intensity, and the light source layer 550A may be illuminated to a second intensity that is about ten percent of the first intensity. To provide a beam angle of fifty degrees, light source layers 550B, 550C, 550D, 550E, 550F, 550G, 550H, and 550I may be illuminated to a first intensity, and the light source layer 550A may be illuminated to a second intensity that is about ten percent of the first intensity. To provide other beam angles, other combinations of the light source layers 550 may be illuminated at varying relative intensities.

As illustrated in FIG. 5G, every light source layer 550 on two sides 540A and 540B is activated (e.g., eighteen total CSP arrays 542 are illuminated) such that the two sides 540A and 540B are emitting light outwardly along the entire length of the lighting tower 316, as indicated by arrows 552, that is reflected by the PAR 314, as indicated by arrows 554. The light reflected by the PAR 314 provides a lighting pattern 556 on a surface. For example, the lighting pattern 556 may be spotlight focused on an object, a person, an animal, or scenery. As illustrated, the lighting pattern 556 is generally circular and a brightness of the lighting pattern 556 is generally even. Additionally, the embodiment of FIG. 5G may produce a beam angle of about 50 degrees (e.g., a size of the lighting pattern 556). As described in greater detail below, the beam angle and/or the lighting pattern provided by the lighting assembly 310 may be adjusted by activating and illuminating only certain sides 540 and/or only certain light source layers 550.

In FIG. 5H, two lower light source layers 550D and 550E on the two sides 540A and 540B are activated (e.g., four total CSP arrays 542 are illuminated) such that only the light source layers 550D and 550E on the two sides 540A and 540B are emitting light outwardly, as indicated by arrows 560, that is reflected by the PAR 314, as indicated by arrows 562. The light reflected by the PAR 314 provides a lighting pattern 564. The lighting pattern 564 is generally circular and generally brighter toward the center (e.g., a center portion 566 of the lighting pattern 564 is generally brighter than an outer portion 568 of the lighting pattern 564). Additionally, the embodiment of FIG. 5G may produce a beam angle of about 15 degrees (e.g., a size of the lighting pattern 564 or a size of the center portion 566 of the lighting pattern 564). As additional and/or other light source layers 550 are activated down the length of the lighting tower 316, such as toward a light source layer 550F, the beam angle and/or a focal size of the lighting pattern provided by the lighting assembly 310 may generally increase.

In FIG. 5I, light source layers 550D, 550E, 550G, 550H, and 550I on the side 540B are activated (e.g., five total CSP arrays 542 are illuminated) such that only CSP arrays 542 on the side 540B are emitting light outwardly, as indicated by arrows 580, that is reflected by the PAR 314, as indicated by arrows 582. The light reflected by the PAR 314 provides a lighting pattern 584. The lighting pattern 564 is generally circular and a brightness of the lighting pattern 556 is generally even. Additionally, the lighting pattern 584 of FIG. 5I is generally smaller compared to the lighting patterns 556 and 564 of FIGS. 5G and 5H, respectively. As such, the CSP arrays 542 of the lighting tower 316 may be controlled, such as by activating only CSP arrays 542 on certain sides 540 or on certain light source layers 550, to provide a desired lighting pattern and/or beam angle.

FIG. 6A illustrates an embodiment of the lighting tower 138 of FIG. 4. The illustrated embodiment includes two light source layers 402. Each light source layer 402 includes 12 sides 403. Base light sources 404 are included on 6 sides 403A of each light source layer 402, and first supplementary light sources 602 and second supplementary light sources 604 are included on the other 6 sides 403B of each light source layer 402. This embodiment of the lighting tower 138 is configured to emit and blend a base color "M" and supplementary colors "L" and "N" to generate a desired color of light at a desired CCT. Base light spectrum "M" is designed to provide the core light needed for all CCTs from 2700K to 6500K (e.g., using the base light sources 404). Color tuning LEDs (e.g., first supplementary light sources 602 and second supplementary light sources 604) offer the specialized additive spectrums "L" and "N" needed to create light ranging from 2700K to 6500K which is the preferred CCT range for adjustable motion picture and television lights, as depicted in FIG. 6A.

The spectrum of the first supplementary light sources 602 are used to add (or blend) the color onto the base color "M" needed to make 3200 Kelvin ("K") CCT (which may be suitable for simulating indoor lighting). The second supplementary light sources 604 provide the spectrum added onto the base color "M" needed to create the 5600K (which may be suitable for simulating outdoor lighting) in this example. The same principle may be applied to generate CCTs ranging from 2700K to 6500K. This approach allows the base light sources 404 to provide approximately 70% of the light, making this system 30% more efficient than the traditional "bi-color" 3200K-5600K blending systems. Thus, the light emitted by the base light sources 404, the first supplementary light sources 602, and the second supplementary light sources 604 may be blended to generate light at a desired color and CCT.

Figure 6B:
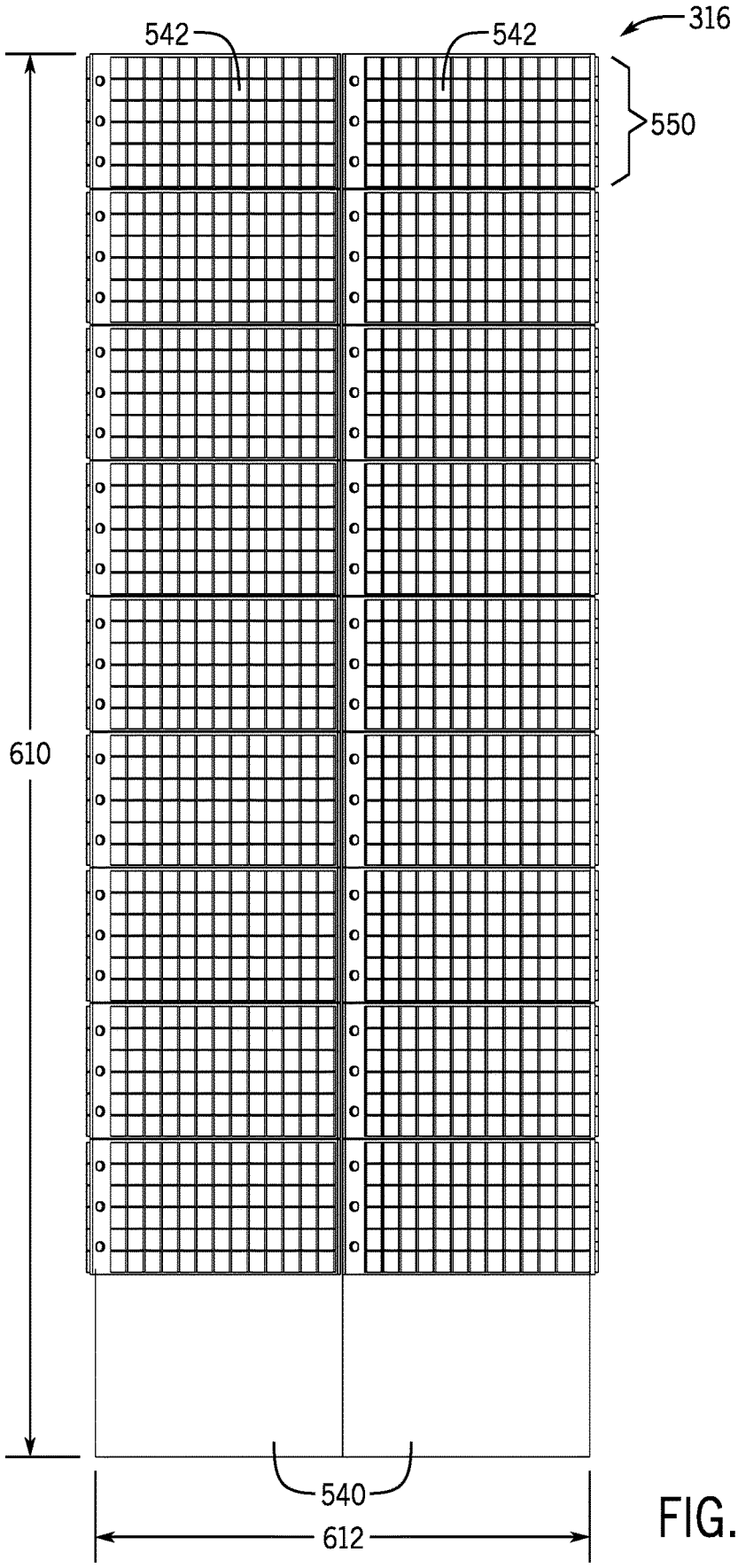
FIG. 6B is an illustration of a lighting tower of the lighting system of FIG. 1 with CCT tuning capabilities, in accordance with one or more current embodiments.

FIG. 6B illustrates an embodiment of the lighting tower 316 of FIG. 3B. As described above, each side 540 of the lighting tower 316 includes nine CSP arrays 542 such that nine light source layers 550 are formed along the lighting tower 316 (e.g., each light source layer 550 includes six CSP arrays 542, and the lighting tower 316 includes 54 total CSP arrays 542). In certain embodiments, the lighting tower 316 may include more or fewer sides 540 and/or more or fewer light source layers 550. As described herein, the CSP arrays 542 may be controlled to achieve a desired beam angle and/or a desired lighting pattern. Further, each CSP array 542 may be independently controlled to emit a particular CCT and/or color. The light emitted from the activated CSP arrays 542 may be reflected by the PAR 314 to achieve the desired beam angle and/or the desired lighting pattern.

In the illustrated embodiment, a length 610 of the lighting tower 316 is generally longer than a width 612. For example, the length 610 may be about 140 mm, and the width 612 may be about 47 mm. In other embodiments, the length 610 and/or the width 612 of the lighting tower 316 may be other suitable dimensions. Further, in some embodiments, the lighting tower 316 may be wider than it is tall. For example, the length 610 may be less than the width 612. In certain embodiments, the length 610 may be generally equal to the width 612. In some embodiments, the lighting tower 316 may be controlled to provide different colors when different CSP arrays within the lighting tower 316 have different colors or different LEDs within a same CSP array have different colors. In these embodiments, the CCT and color for the lighting tower 316 may be independently controlled.

Figure 6C:
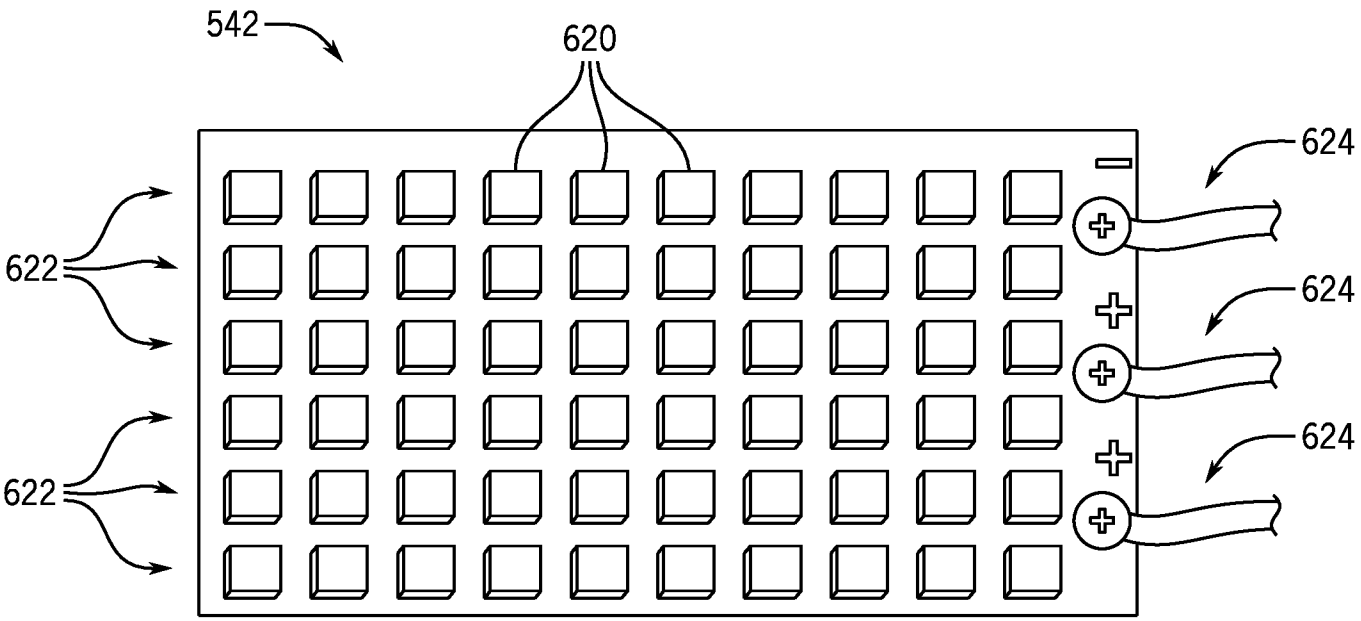
FIG. 6C is an illustration of an LED array of the lighting tower of FIG. 6B, in accordance with one or more current embodiments.

FIG. 6C is an illustration of the CSP array 542 of the lighting tower 316 of FIG. 6B. The CSP array 542 includes LED's 620 configured to emit light at a desired CCT. As illustrated, the CSP array 542 includes sixty LED's 620 arranged in six rows 622 and ten LED's 620 in each row 622. In certain embodiments, the CSP array 542 may include more or fewer LED's 620. Further, in some embodiments, the lighting tower 316 may include CSP arrays 542 having varying amounts of LED's 620 (e.g., some CSP arrays 542 may have more LED's 620 than other CSP arrays 542).

The CSP array 542 includes wired connections 624 configured to provide power and/or communication to the LED's 620 and the CSP array 542 generally. For example, activating the LED's 620 of the CSP array 542 and/or achieving the desired CCT may be accomplished via the wired connections 624. In certain embodiments, the CSP array 542 may be coupled to the lighting tower 316 via the wired connections 624.

Figure 7B:
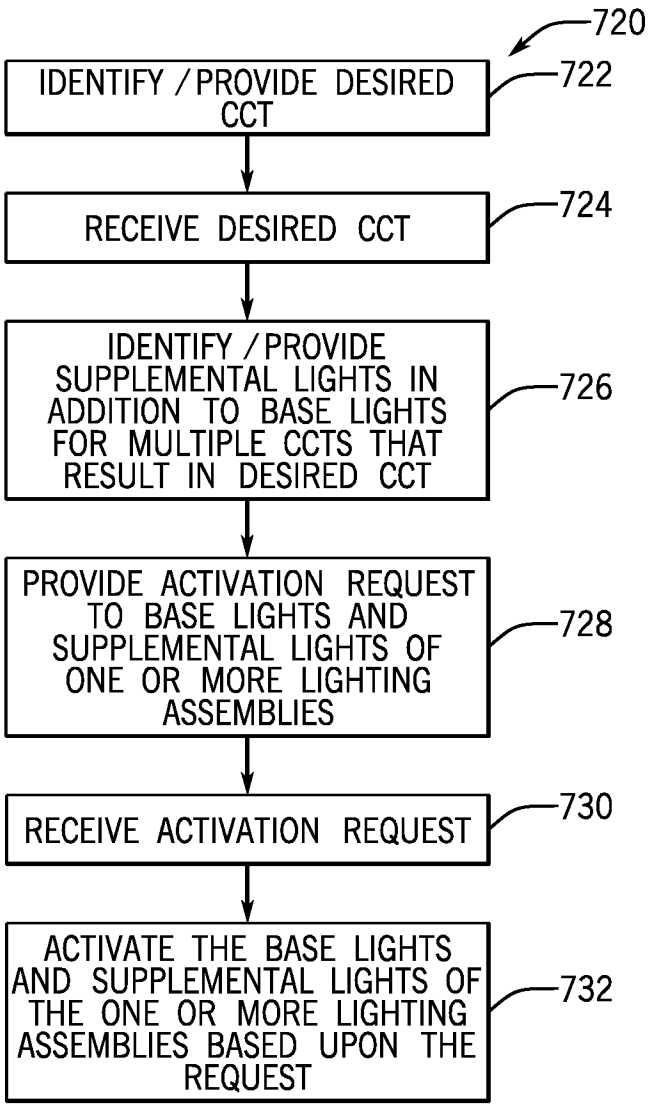
FIG. 7B is a flow diagram for controlling a CCT of the lighting tower of the lighting system of FIG. 1, in accordance with one or more current embodiments.
Figure 7A:
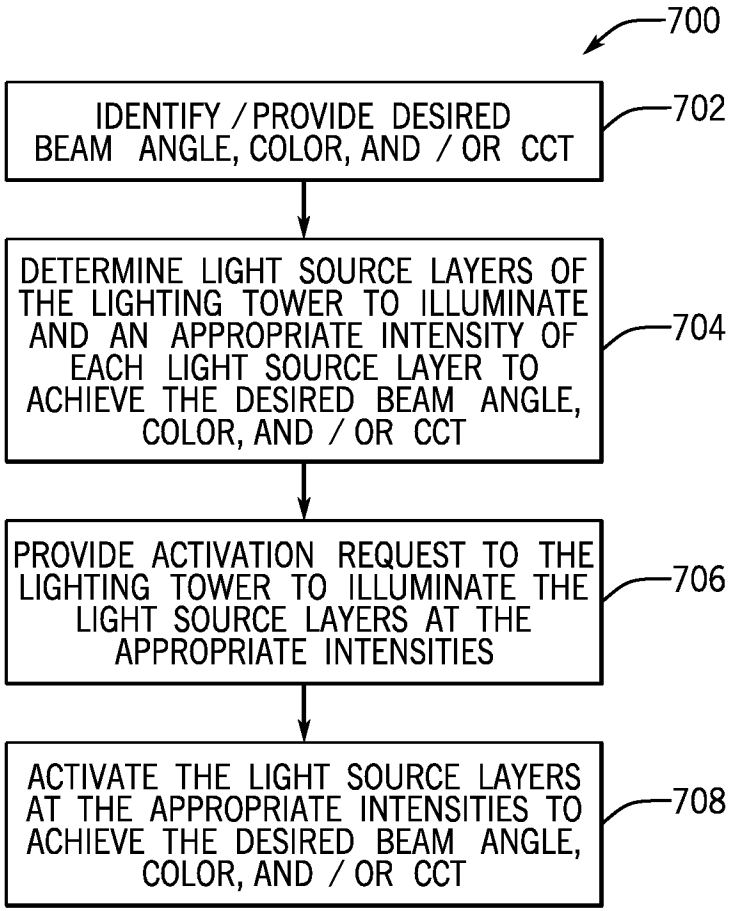
FIG. 7A is a flow diagram for controlling a beam angle, color, and CCT of the lighting tower of the lighting system of FIG. 1, in accordance with one or more current embodiments.

FIG. 7A is a flow diagram 700 for controlling a beam angle, a color, and/or a CCT in an exemplary embodiment of the lighting system 100 of FIG. 1. Each block of flow diagram 700 (e.g., blocks 702, 704, 706, and 708) may be performed by the digital control system 120 and/or the lighting assembly controller 136. As described above, the lighting system 100 may be configured to provide desired beam angles, colors, and/or CCT's. For example, a user may provide inputs related to a beam angle, a color, and/or a CCT to the user interface 127 of the digital control system 120 of FIG. 1. At block 702, based on the inputs, the digital control system 120 may identify and/or provide a desired beam angle, a desired color, and/or a desired CCT to be generated by the lighting system 100 or by an individual lighting assembly 130 based on the user inputs. For example, a lighting operator may indicate a particular desired beam angle, color, and/or CCT via the user interface 127.

At block 704, the controller 122 may determine which light source layers 402 of the lighting tower 138 or which light source layers 550 of the lighting tower 316 to illuminate and the appropriate intensity for each illuminated light source layer 402 and 550 that will achieve the desired beam angle, the desired color, and the desired CCT. For example, illumination of certain light source layers 550 at certain intensities may achieve the desired beam angle, the desired color, and the desired CCT.

At block 706, the controller 122 may provide an activation request to the lighting assemblies 130 and/or 310. For example, the controller 122 may output a signal to a lighting assembly 130 and/or 310 via a wired connection 124 and/or a wireless connection 126 indicative of the specific light source layers 402 and/or 550 of the lighting towers 138 and 316, respectively, to activate and a corresponding amount of power (e.g., the respective intensities) to be supplied to the light source layers 402 and/or 550. In some embodiments, the controller 136 may be configured to provide the activation request to the lighting assemblies 130 and/or 310.

At block 708, the lighting assembly controller 136 may activate the lighting assemblies 130 and/or 310 based upon the activation request. As described above, the activation request may identify specific light source layers 402 and/or 550 of the lighting towers 138 and 316, respectively, to activate and the corresponding power to be supplied to each light source layer 402 and/or 550. The lighting assembly controller 136 may output signals to the lighting towers 138 and 316 to activate the specific lights and provide the specific amounts of power. With this activation of the light source layers 402 and/or 550, the desired beam angle, the desired color, and/or the desired CCT may be provided.

FIG. 7B is a flow diagram 720 for controlling a CCT in an exemplary embodiment of the lighting system 100 of FIG. 1. Each block of flow diagram 720 (e.g., blocks 722, 724, 726, 728, 730, and 732) may be performed by the digital control system 120 and/or the lighting assembly controller 136. As described above, the lighting system 100 may be configured to blend light of varying CCTs to generate a desired CCT. A user may provide inputs to the user interface 127 of the digital control system 120 of FIG. 1. At block 722, based on the inputs, the digital control system 120 may identify and/or provide a desired CCT to be generated by the lighting system 100 or by an individual lighting assembly 130. For example, a lighting operator may indicate a particular desired CCT via the user interface 127.

At block 724, the controller 122 may receive the desired CCT. For example, a user may provide various inputs to the user interface 127 indicative of a desired CCT. Those inputs may then be sent from the user interface 127 to the processor 128. In embodiments where block 724 is performed by the lighting assembly controller 136, the lighting assembly controller 136 may receive a signal indicative of the desired CCT.

At block 726, the controller 122 may identify supplemental lights (e.g., first supplementary light sources 602 and second supplementary light sources 604) to be added to the base lights (e.g., base light sources 404) of the lighting tower 138 based at least upon the desired CCT. The controller 122 may also determine the power to be supplied to each base light and supplement light. By varying which lights are activated and the amount of power supplied to the activated lights, a desired CCT ranging from 2700K to 6500K may be generated using base lighting of the base light source 404 supplemented by lighting from the first supplemental light source 602 and/or the second supplemental light source 604. Therefore, based at least on the desired CCT, the controller 122 may determine which base lights and supplement of the lighting tower 138 to activate and the amount of power to supply to each light to achieve the desired CCT. In some embodiments, the controller 136 may be configured to identify supplemental lights (e.g., first supplementary light sources 602 and second supplementary light sources 604) to be added to the base lights (e.g., base light sources 404) of the lighting tower 138 based at least upon the desired CCT.

At block 728, the controller 122 may provide an activation request to the one or more lighting assemblies 130. For example, the controller 122 may output a signal to a lighting assembly 130 via a wired connection 124 indicative of the specific lights of the lighting tower 138 to activate and a corresponding amount of power to be supplied to individual lights. In other embodiments, the controller 122 may output a signal to a lighting assembly 130 via a wireless connection 126 indicative of the specific lights of the lighting tower 138 to activate. In some embodiments, the controller 136 may be configured to provide the activation request to the one or more lighting assemblies 130.

At block 730, the lighting assembly controller 136 may receive the activation request. As described above, the activation request may identify base light sources 404, first supplementary lights 602, and second supplementary lights 604 of the lighting tower 138 to activate, along with the corresponding power to be supplied to each, to achieve the desired CCT. A signal indicative of the activation request may be received via the wired connection 124, via the wireless connection 126, or via both.

At block 732, the lighting assembly controller 136 may activate the one or more lighting assemblies 130 based upon the activation request. As described above, the activation request may identify specific lights of the lighting tower 138 to activate and the corresponding power to be supplied to each light. The lighting assembly controller 136 may output signals to the lighting tower 138 to activate the specific lights and provide the specific amounts of power. With this activation of the lights of the lighting tower 138, the desired CCT is generated.

Figure 8:
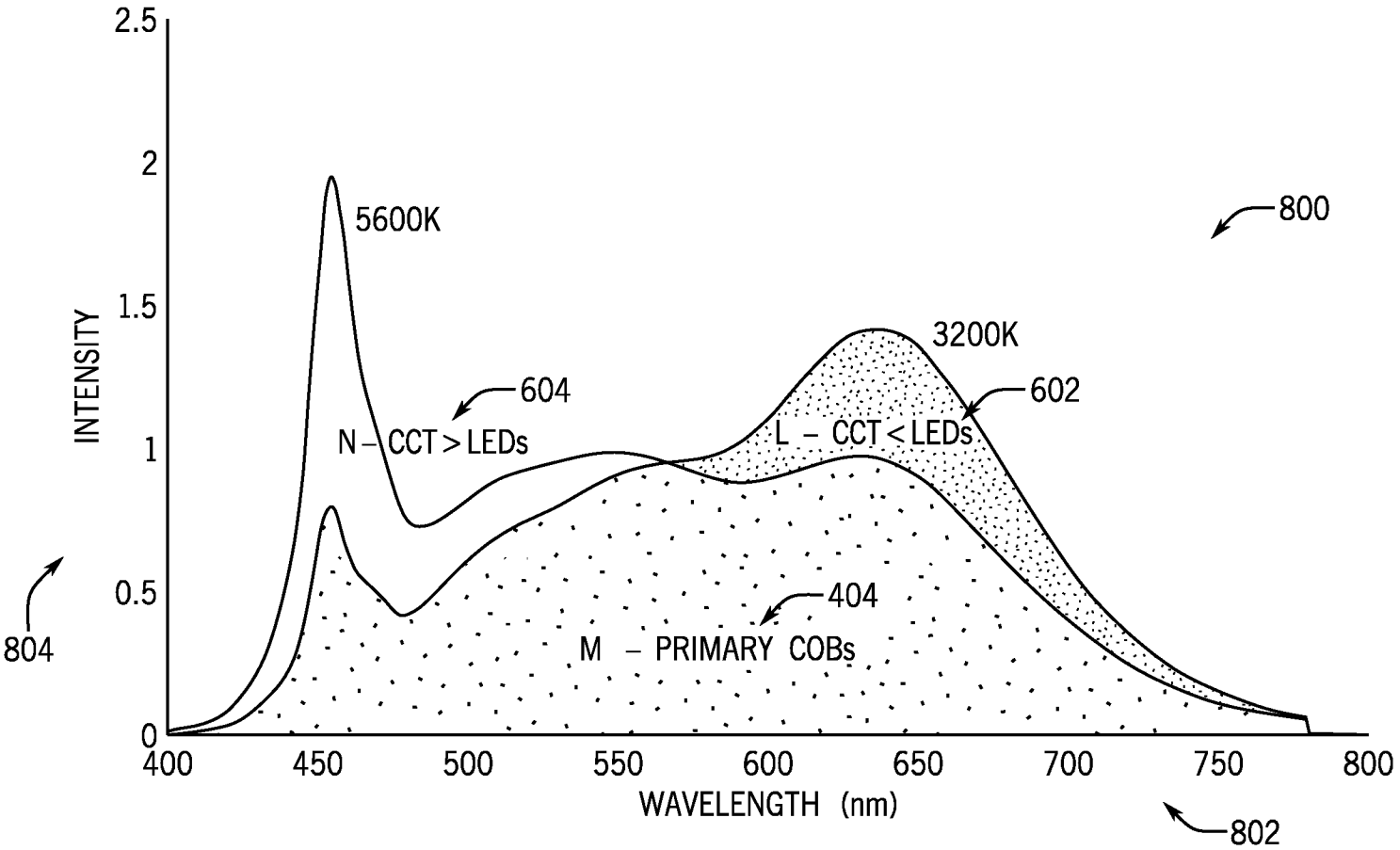
FIG. 8 is a graphical illustration of light spectrum that may be generated by the lighting system of FIG. 1, in accordance with one or more current embodiments.

FIG. 8 is a graphical illustration 800 of light spectrums that may be generated by the lighting system 100 of FIG. 1. In the graphical illustration 800, the x-axis 802 depicts a wavelength (or frequency) of light that may be generated by each of the base light sources 404 ("M-primary COBs"), first supplementary light sources 602 ("L–CCT>LEDs"), and second supplementary light sources 604 ("N–CCT>LEDs"). The y-axis depicts a relative intensity value that may be generated by each light source. As illustrated, the base light sources 404 may generate light having a wavelength ranging from 400 nm to 780 nm and a relative intensity slightly less than 1. The supplementary light sources (e.g., the first supplementary light sources 602 and the second supplementary light sources 604) may provide additive light. For example, first supplementary light sources 602 may provide additive light ranging in wavelength from about 570 nm to 780 nm and a relative intensity up to about 1.45. Second supplementary lights 604 may provide additive light ranging in wavelength from about 400 nm to 570 nm.

Certain combinations of light from each of the base light sources 404, the first supplementary light sources 602, and the second supplementary light sources 604 may generate light at desired CCTs. For example, as illustrated a combined light including light "M" from the base light sources 404 and light "L" the first supplementary light sources 602 may generate a CCT of 3200K. By contrast, light "M" combined with light "N" from the second supplementary light sources 604 may generated a CCT of 5600K. As such, light emitted from each of the base light sources 404, the first supplementary light sources 602, and the second supplementary light sources 604 may be blended to generate a desired CCT. For example, adjustments may include determining a subset of the supplementary light sources 602 and 604 that provide an offset color that would shift the base light 404 to the desired CCT. In some embodiments, a first subset of supplementary lights may be configured to adjust the CCT to a first value (e.g., 3200K), and a second subset of supplementary lights may be configured to adjust the CCT to a second value (e.g., 5600K).

Figure 9:
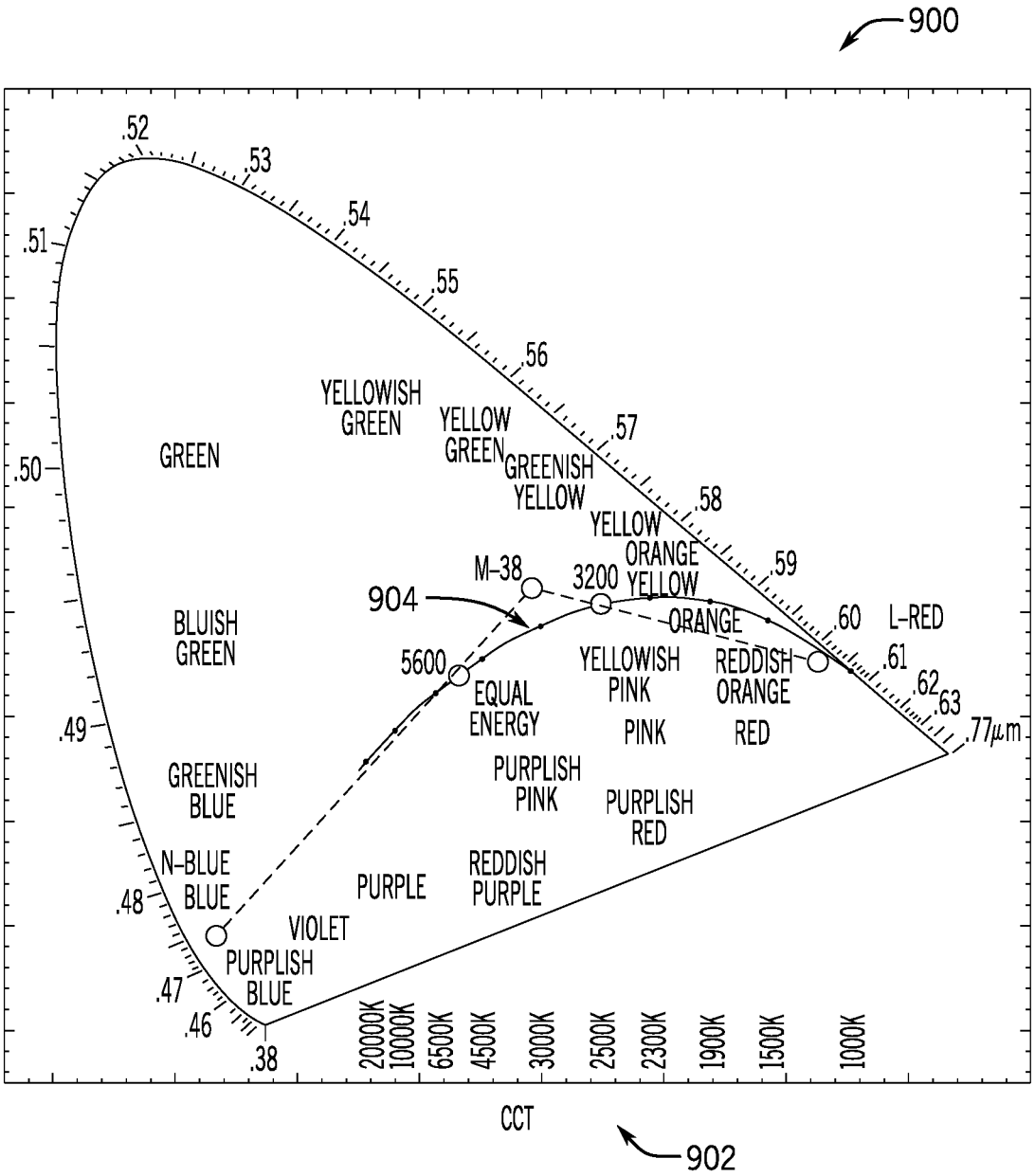
FIG. 9 is a diagram of colors and CCTs that may be generated by the lighting system of FIG. 1, in accordance with one or more current embodiments.

FIG. 9 is a diagram 900 of colors and CCTs that may be generated by the lighting system 100 of FIG. 1. The diagram 900 shows the color space that may be achieved with the lighting system 100. In addition to CCT adjustment, a certain amount of green adjustment may be made to the white light to move it off of a black body curve 904 for effects and color tuning. For example, the green adjustment may be positive or negative relative to a base white light. The diagram 900 includes an x-axis having a range of CCTs from 1000K to 20000+K. As generally described herein, the lighting system 100 may be configured to generate light ranging from 2700K to 6500K.

While the various embodiments described above include certain embodiments configured to adjust a beam angle of a lighting assembly 130, and other embodiments configured to adjust a CCT of a lighting assembly 130, an exemplary embodiment of the lighting system 100 includes the ability to adjust both a beam angle and a CCT of a lighting assembly 130. In such embodiments, beam angle and CCT adjustments may be implemented via non-mechanical means, resulting in significant benefits such as reduced maintenance and increased operability.

Figure 10A:
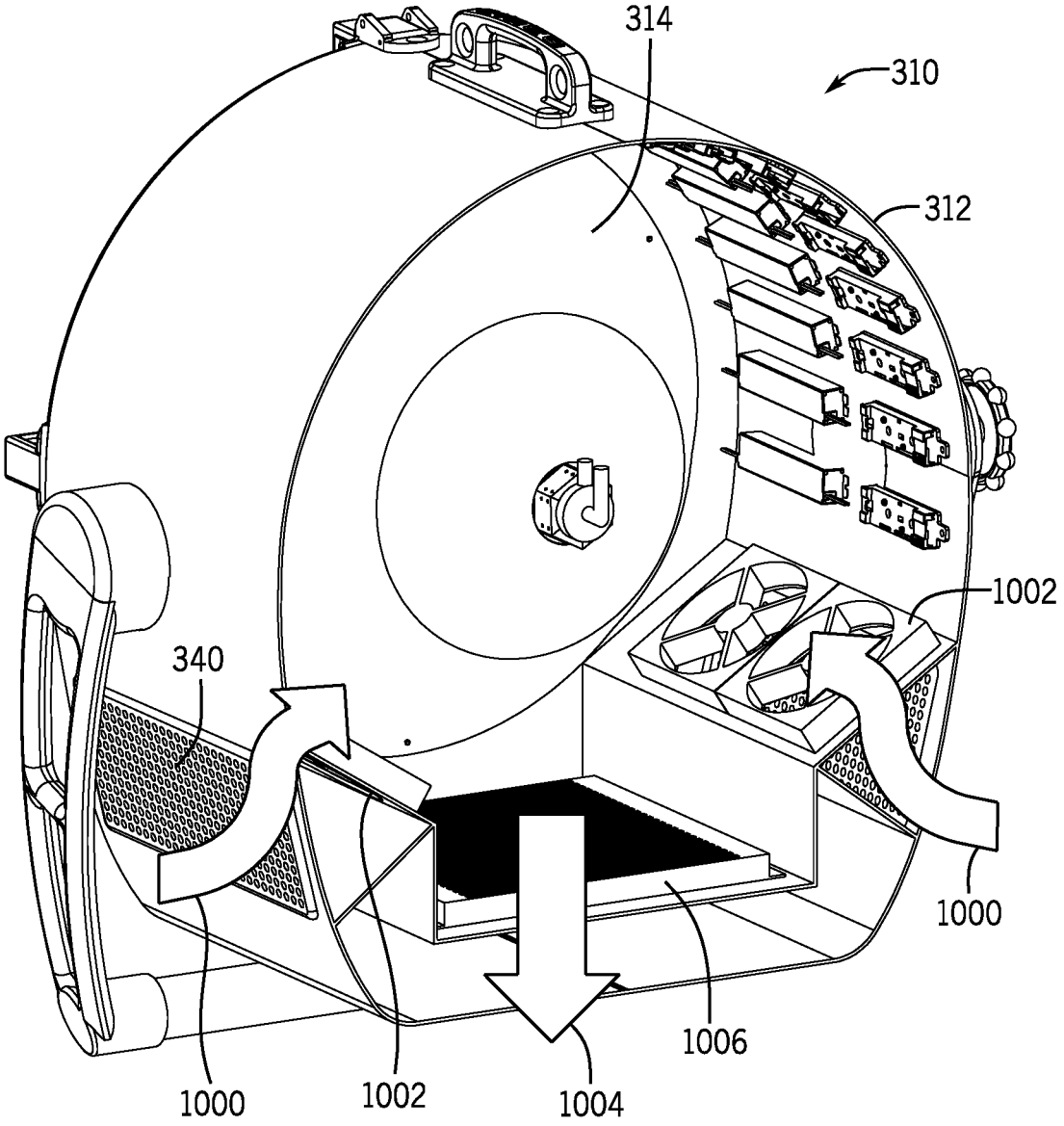
FIGS. 10A and 10B are perspective rear views of the lighting assembly of FIG. 3B, in accordance with one or more current embodiments.

FIG. 10A is a rear perspective view of the lighting assembly 310 of FIG. 3B. Cooling of the lighting assembly 310 may be enhanced via active cooling. For example, heat generated by operation of the lighting tower 316 (e.g., operation of the LED's 620) may be dissipated to ambient air flowing through the lighting assembly 310. As illustrated, the vents 340 may enable air flow into the lighting assembly 310, as indicated by arrows 1000. The air flow into the lighting assembly 310 may be caused by low pressure within the lighting assembly 310 and/or by fans 1002 within the lighting assembly 310. The fans 1002 are positioned generally above the vents 340 and are angled relative to the vents 340 to substantially prevent water and other debris from entering the lighting assembly 310.

After entering the lighting assembly 310, the air flow may contact and absorb heat from the chassis 312, the PAR 314, the lighting tower 316, and/or other components of the lighting assembly 310. Additionally or alternatively, the air may flow generally downwardly and may exit the lighting assembly 310, as indicated by arrow 1004. In certain embodiments, as described in greater detail below, the lighting assembly 310 may include a coolant system configured to flow a coolant through the lighting tower 316 and a condenser 1006. The air flow exiting the lighting assembly 310 (e.g., arrow 1004) may pass through and/or over the condenser 1006 to exchange heat with the coolant flowing from the lighting tower 316 and through the condenser 1006.

Figure 10B:
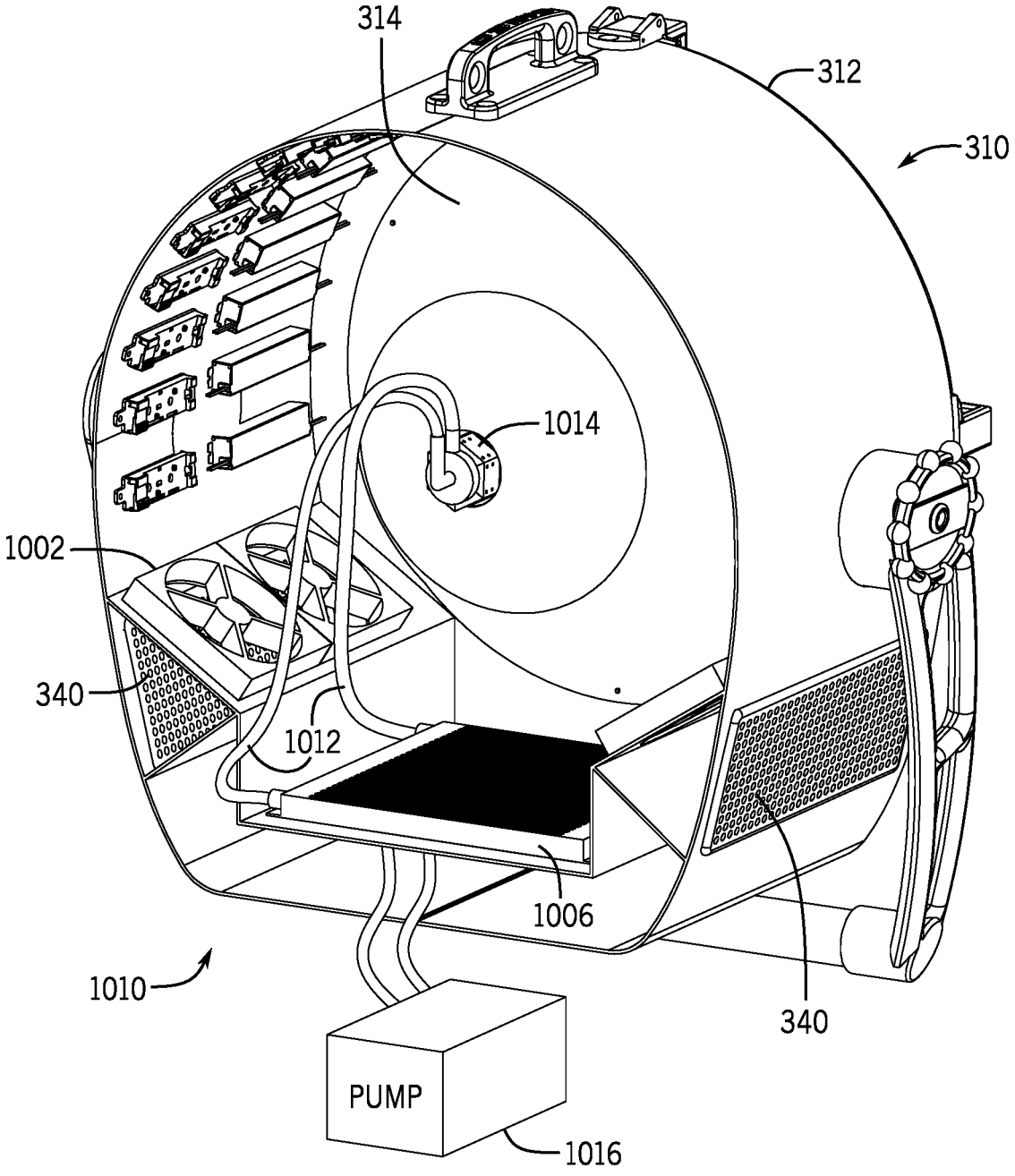

FIG. 10B is a rear perspective view of the lighting assembly 310 of FIG. 3B. As illustrated, the lighting assembly 310 includes a cooling system 1010 configured to actively cool the lighting tower 316. The cooling system 1010 includes the condenser 1006, coolant pipes 1012, and piping within the lighting tower 316. As illustrated, the coolant pipes 1012 are coupled to the condenser 1006 and a base 1014 of the lighting tower 316. The coolant pipes 1012 are configured to carry coolant between the condenser 1006 and the lighting tower 316. For example, the coolant pipes 1012 may carry chilled coolant from the condenser 1006 to the lighting tower 316. The chilled coolant may pass through the lighting tower 316 and absorb heat generated by LED's 620 of the CSP arrays 542. Heated coolant may exit the lighting tower 316, and the coolant pipes 1012 may carry the heated coolant back to the condenser 1006. The condenser 1006 may condense and/or cool the heated coolant via the airflow 1004. The chilled coolant may return to the lighting tower 316 to continue cooling the lighting tower 316. In certain embodiments, the lighting tower 316 may include a pump 1016 within the lighting tower 316 or exterior to the lighting tower 316 that is configured to force the coolant to flow through the lighting tower 316, the coolant pipes 1012, and the condenser 1006.

Figure 11A:
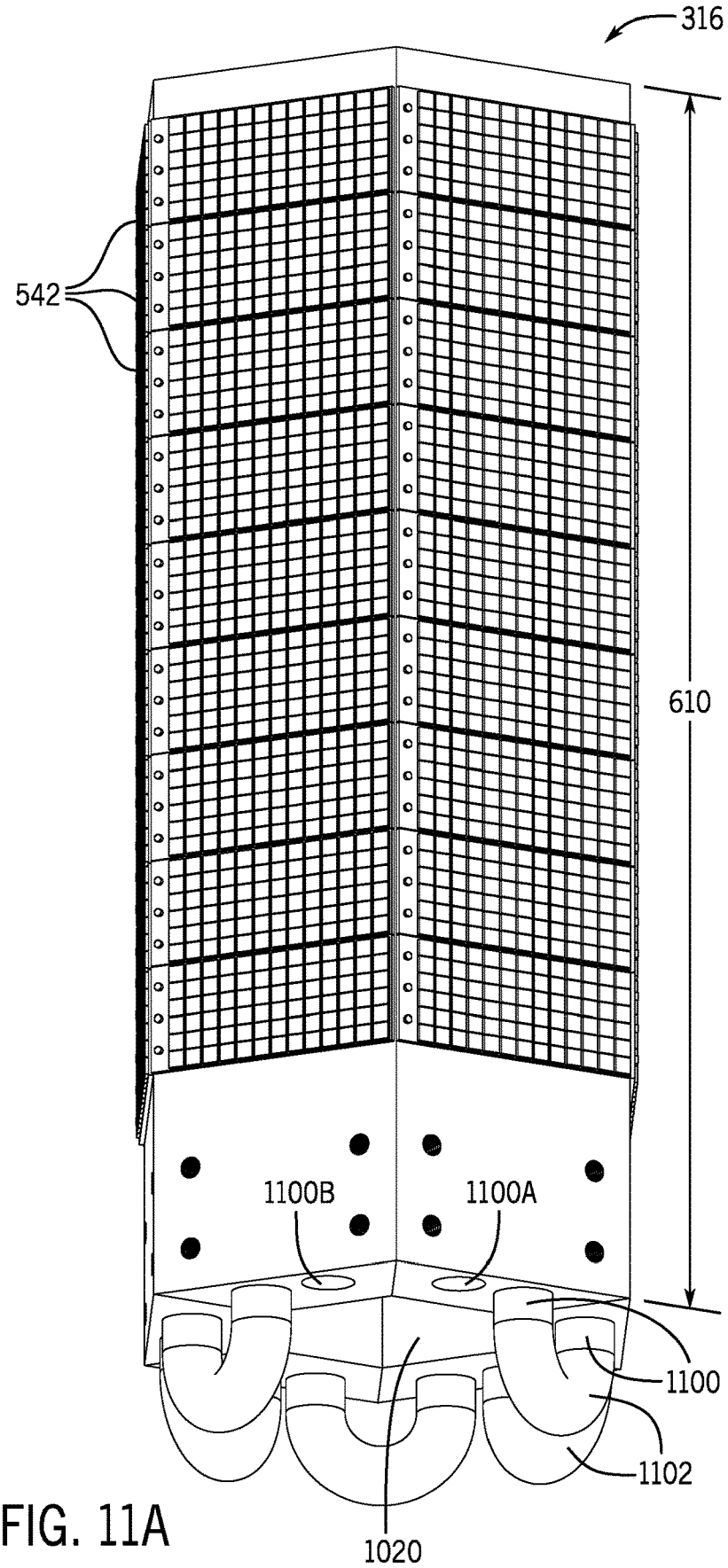
FIGS. 11A and 11B are perspective views of a lighting tower of the lighting system of FIG. 1, in accordance with one or more current embodiments.

FIG. 11A is a perspective view of an embodiment of the lighting tower 316 of the lighting system 100 of FIG. 1. For example, the embodiment of FIG. 11A may be employed within the lighting assembly 310. As illustrated, the lighting tower 316 and the cooling system 1010 include heat pipes 1100 extending into the lighting tower 316 and coupled to one another. As described in greater detail in reference to FIG. 11A, the heat pipes 1100 may extend along the length 610 of the lighting tower 316. The heat pipes 1100 are connected via connections 1102 (e.g., "U-joints") configured to pass coolant from one heat pipe 1100 to another heat pipe 1100.

The cooling system 1010 may flow coolant to and from the lighting tower 316 via a first heat pipe 1100A and a second heat pipe 1100B, respectively. For example, the coolant pipes 1012 may be coupled to and configured to flow coolant to and from the first heat pipe 1100A and the second heat pipe 1100B. The coolant may enter the lighting tower 316 at the first heat pipe 1100A as a chilled coolant, flow through the heat pipes 1100 and the connections 1102, and exit the lighting tower 316 at the second heat pipe 1100B as a heated coolant. After exiting the lighting tower 316, the heat coolant may be chilled by the condenser 1006 to provide further cooling thereafter. To facilitate heat transfer, the heat pipes 1100 may be made of copper and/or of other suitable conductive materials.

As illustrated, the lighting tower 316 also includes a core 1020 that is generally hollow to enable wiring to pass along the length 610 of the lighting tower 316 within the lighting tower 316. For example, the wiring connected to the individual CSP arrays 542 may extend into the lighting tower 316 and the core 1020 and may extend to a power source and/or controller. In embodiments with fifty-four CSP arrays 542 (e.g., nine CSP arrays 542 on each side 540), the core 1020 may provide area for wiring to all fifty-four CSP arrays 542 (e.g., about one hundred sixty-two wires).

Figure 11B:
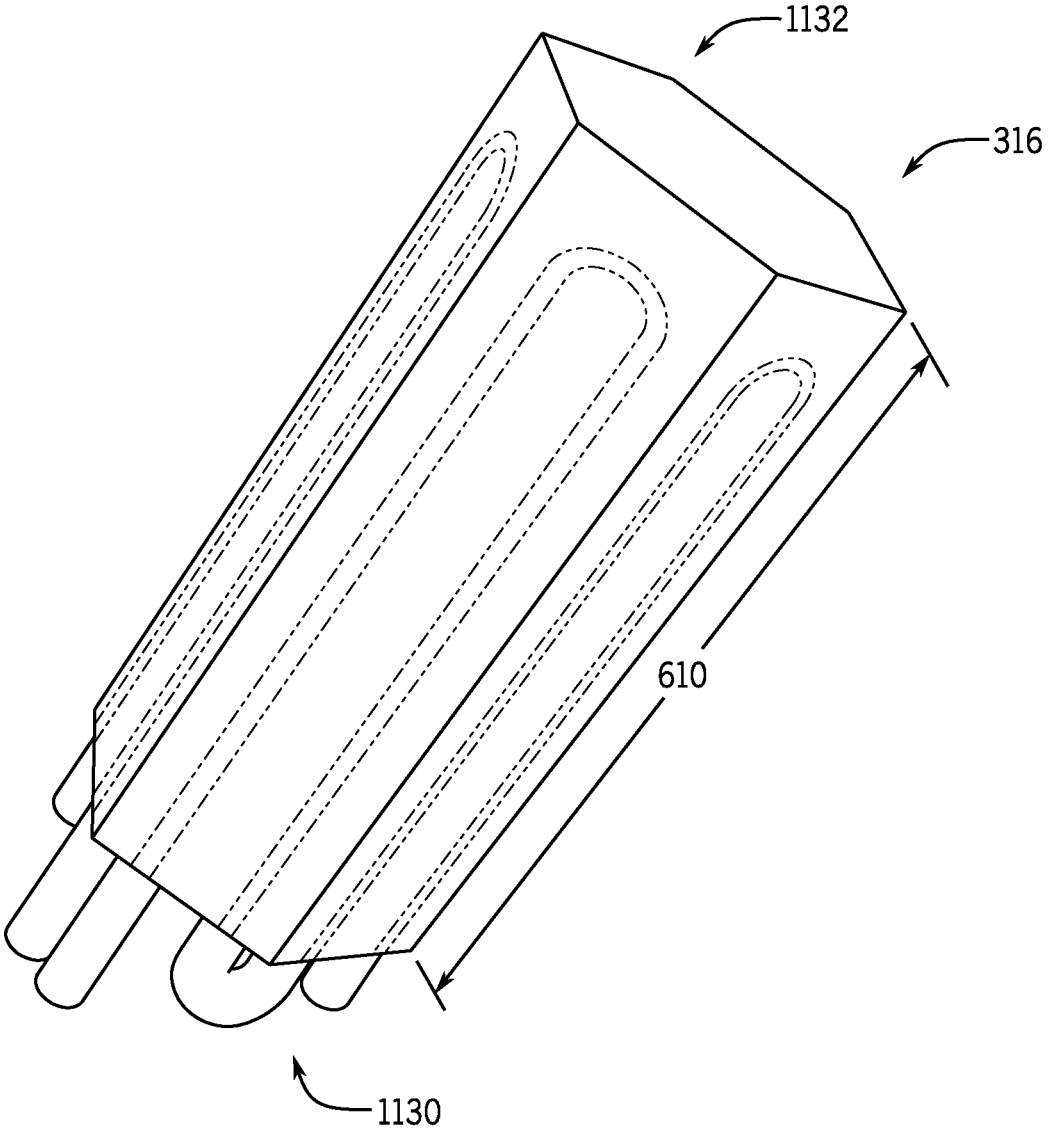

FIG. 11B is a perspective view of an embodiment of the lighting tower 316 of the lighting system 100 of FIG. 1. For example, the embodiment of FIG. 11B may be employed within the lighting assembly 310. As illustrated, the heat pipes 1100 extend along the length 610 of the lighting tower 316 and are coupled to one another such that the coolant may pass from one heat pipe 1100 to another. Each side 540 of the lighting tower 316 includes two heat pipes 1100 extending between a first end 1130 and a second end 1132 of the lighting tower 316. For each side 540, the coolant may flow from the first end 1130 to the second end 1132 along a first heat pipe 1100 and flow from the second end 1132 to the first end 1130 along a second heat pipe 1100. As such, the heat pipes 1100 may provide effective cooling of the lighting tower 316 via the coolant flow.

Figure 12:
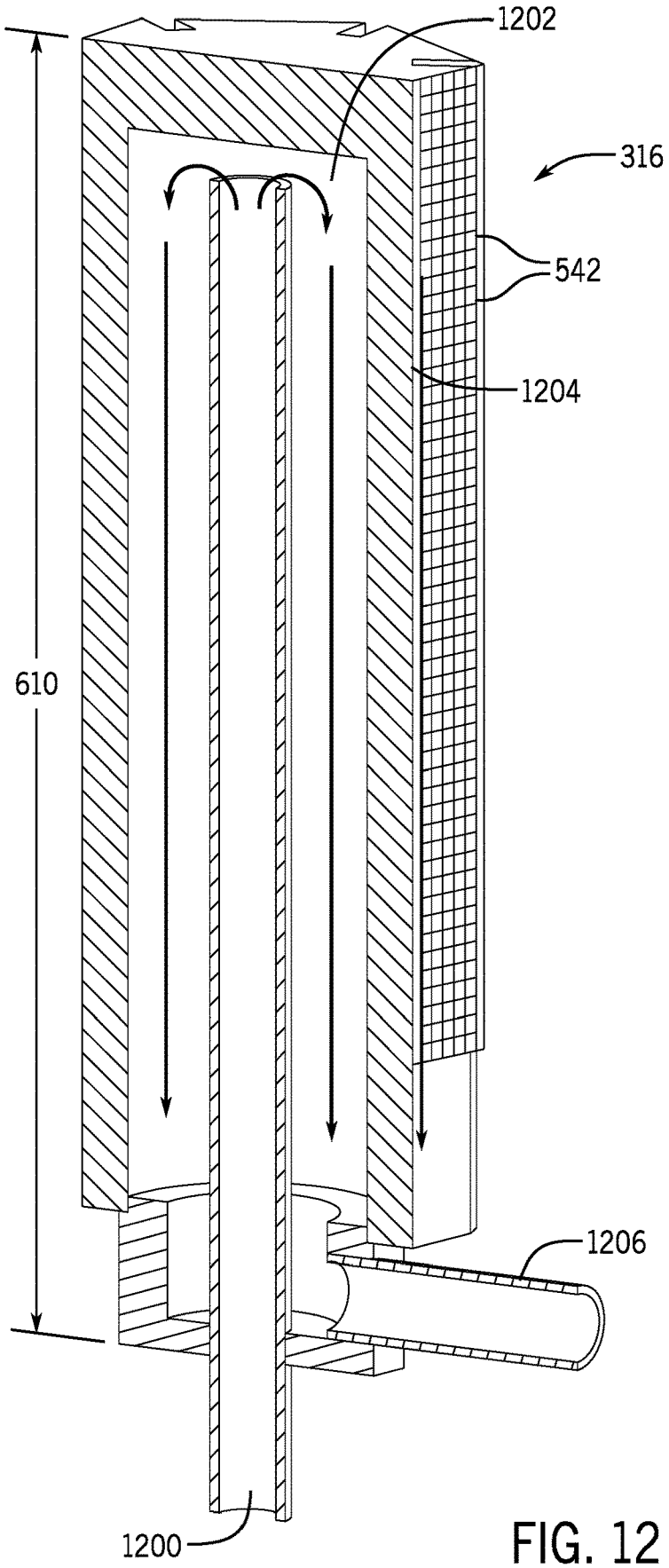
FIG. 12 is a cross-sectional view of a lighting tower of the lighting system of FIG. 1, in accordance with one or more current embodiments.

FIG. 12 is a cross-sectional view of an embodiment of the lighting tower 316 of the lighting system 100 of FIG. 1. For example, the embodiment of FIG. 12 may be employed within the lighting assembly 310. As illustrated, the cooling system 1010 includes heat pipes 1200 and 1202 configured to flow coolant through the lighting tower 316 to absorb heat generated by the LED's 620 of the CSP arrays 542. The heat pipe 1200 may be an inlet pipe configured to receive chilled coolant and pass the chilled coolant along the length 610 of the lighting tower 316. The coolant may flow into the heat pipe 1202 that extends between the heat pipe 1200 and a casing 1204 of the lighting tower 316 that is coupled to the CSP arrays 542. The coolant may flow down the heat pipe 1202 and toward an outlet 1206. The coolant may then exit the lighting tower 316 via the pipe 1206 as a heated coolant, which may be chilled via the condenser 1006 and returned to the lighting tower 316. In certain embodiments, the fluid flow may be reversed such that the pipe 1206 as a chilled coolant, flows through the heat pipe 1202 and absorbs heat, and exits the lighting tower 316 via the heat pipe 1200.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A lighting assembly comprising:

a lighting tower, wherein the lighting tower comprises:

a plurality of layers of lighting elements, wherein each layer of lighting elements is configured to provide a different angle of emitted light with respect to light emitted from another layer of lighting elements when reflected by a parabolic reflector, and wherein each lighting element of the plurality of layers of lighting elements is configured to be independently activated while maintaining a desired CCT; and a controller comprising a processor and a memory, wherein the processor is configured to:

identify a desired beam angle and the desired CCT based upon one or more inputs from a user interface;

identify one or more layers of lighting elements of the plurality of layers that, when activated within the parabolic reflector, generate the desired beam angle;

provide a first activation request to the one or more layers of the lighting elements, wherein the first activation request causes activation of the one or more layers of the lighting elements, and wherein the activation of the one or more layers of the lighting elements generates the desired beam angle;

identify one or more adjustments to the one or more layers of the lighting tower that would generate the desired CCT;

provide a second activation request to the one or more layers of the lighting tower, wherein the second activation request causes the one or more adjustments to the one or more layers of the lighting tower, such that the desired CCT is generated; and provide a third activation request to one or more lighting elements of the lighting tower, wherein the third activation request causes activation or deactivation of the one or more lighting elements while maintaining the desired CCT.

2. The lighting assembly of claim 1, comprising the parabolic reflector coupled to the lighting tower.

3. The lighting assembly of claim 1, comprising a chassis coupled to the lighting tower.

4. The lighting assembly of claim 3, wherein the chassis comprises a heat sink configured to absorb and dissipate heat generated by the lighting tower.

5. The lighting assembly of claim 1, wherein each layer of lighting elements is configured to be remotely activated via a controller communicatively coupled to the lighting assembly.

6. The lighting assembly of claim 1, wherein each layer of lighting elements comprises a layer of light-emitting diodes ("LEDs").

7. The lighting assembly of claim 1, wherein the layer of lighting elements of the plurality of layers of lighting elements extends horizontally along a perimeter of the lighting tower.

8. The lighting assembly of claim 1, wherein each lighting element comprises a plurality of LEDs.

9. The lighting assembly of claim 1, wherein each lighting element comprises:

electronic circuitry;

an array of LEDs disposed on the electronic circuitry; and one or more wired connections electrically coupled to the electronic circuitry.

10. A hardware circuitry-implemented method for adjusting a beam angle of a lighting assembly, the method comprising:

identifying a desired beam angle and a desired CCT based upon one or more inputs from a user interface;

identifying one or more layers of lighting elements of a lighting tower that, when activated within a parabolic reflector, generate the desired beam angle, wherein each layer of lighting elements is configured to provide a different beam angle of emitted light with respect to light emitted from another layer of lighting elements when reflected from the parabolic reflector;

providing a first activation request to the one or more layers of the lighting elements, wherein the first activation request causes activation of the one or more layers of the lighting elements, and wherein the activation of the one or more layers of the lighting elements generates the desired beam angle;

identifying one or more adjustments to the one or more layers of the lighting tower that would generate the desired CCT;

providing a second activation request to the one or more layers of the lighting tower, wherein the second activation request causes the one or more adjustments to the one or more layers of the lighting tower, such that the desired CCT is generated; and providing a third activation request to one or more lighting elements of the lighting tower, wherein the third activation request causes activation or deactivation of the one or more lighting elements while maintaining the desired CCT.

11. The hardware circuitry-implemented method of claim 10, wherein the method is implemented by a digital control system that provides the first activation request, the second activation request, and the third activation request to a lighting assembly controller.

12. The hardware circuitry-implemented method of claim 10, comprising increasing an intensity of light reflected by the parabolic reflector by requesting additional layers of the lighting elements to be activated.

13. The hardware circuitry-implemented method of claim 10, wherein the activation of the one or more layers causes light to be emitted by the one or more layers toward the parabolic reflector, wherein the emitted light is reflected by the parabolic reflector, and wherein the reflected light generates the beam angle.

14. A hardware circuitry-implemented method for providing an adjustable color-correlated temperature ("CCT") comprising:

receiving an indication of a desired CCT from a user interface;

determining one or more adjustments to one or more supplementary light sources of a layer of light sources on a lighting tower, that would result in the desired CCT when light from the one or more supplementary light sources is blended with a base light from a base light source of the layer of light sources on the lighting tower, wherein the one or more supplementary light sources are disposed on one or more first sides of the lighting tower, and wherein the base light of the lighting tower is disposed on a second side of the lighting tower different from the one or more first sides of the lighting tower; and performing the one or more adjustments to the one or more supplementary light sources to generate the desired CCT.

15. The hardware circuitry-implemented method of claim 14, wherein the desired CCT is between 3200 Kelvin and 5600 Kelvin.

16. The hardware circuitry-implemented method of claim 14, wherein determining the one or more adjustments comprises determining a subset of the one or more supplementary light sources that provide an offset color that would shift the base light to the desired CCT.

17. The hardware circuitry-implemented method of claim 16, wherein the offset color comprises a plus or minus green adjustment.

18. The hardware circuitry-implemented method of claim 14, wherein a first subset of the one or more supplementary light sources is configured to adjust a CCT to 3200 Kelvin, and wherein a second subset of the one or more supplementary light sources is configured to adjust the CCT to 5600 Kelvin.

19. The hardware circuitry-implemented method of claim 14, wherein the base light source of the lighting tower emits a majority of the light emitted by the lighting tower and the one or more supplementary light sources emit a minority of the light emitted by the lighting tower.

20. A lighting assembly, comprising:

a lighting tower configured to emit light, wherein the lighting tower comprises a plurality of sides; and a cooling system configured to cool the lighting tower, wherein the cooling system comprises:

a thermal circuit extending along the plurality of sides of the lighting tower, wherein the thermal circuit comprises:

an inlet configured to receive a coolant into the lighting tower;

an outlet configured to flow the coolant out of the lighting tower, wherein the inlet and the outlet are disposed at an end of the lighting tower;

a first chamber configured to receive the coolant from the inlet and to flow the coolant in a first direction within the lighting tower; and a second chamber configured to receive the coolant from the first chamber and to flow the coolant in a second direction, opposite the first direction, within the lighting tower, wherein the second chamber extends generally between the first chamber and a casing coupled to the lighting tower;

a condenser configured to cool the coolant passing through the thermal circuit; and a pump configured to pump the coolant from the condenser, through the thermal circuit, and back to the condenser, wherein the coolant is configured to absorb heat generated by the lighting tower due to light emission as the coolant passes through the thermal circuit.

21. The lighting assembly of claim 20, wherein the lighting tower comprises a plurality of lighting elements configured to emit light, and wherein the coolant is configured to absorb heat generated by the plurality of lighting elements due to the light emission.

22. The lighting assembly of claim 20, comprising a fan configured to draw air into the lighting assembly and over the condenser to promote cooling of the coolant within the condenser.

23. The lighting assembly of claim 20, wherein the lighting tower comprises a hollow core configured to extending within the thermal circuit, and wherein the hollow core is configured to provide for wiring of the lighting tower.

* * * * *